US007935196B2

(12) United States Patent
Ohta et al.

(10) Patent No.: US 7,935,196 B2
(45) Date of Patent: May 3, 2011

(54) SOFT MAGNETIC RIBBON, MAGNETIC CORE, MAGNETIC PART AND PROCESS FOR PRODUCING SOFT MAGNETIC RIBBON

(75) Inventors: Motoki Ohta, Kumagaya (JP); Yoshihito Yoshizawa, Kumagaya (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/531,613

(22) PCT Filed: Mar. 4, 2008

(86) PCT No.: PCT/JP2008/053798

§ 371 (c)(1), (2), (4) Date: Sep. 16, 2009

(87) PCT Pub. No.: WO2008/114605

PCT Pub. Date: Sep. 25, 2008

(65) Prior Publication Data

US 2010/0108196 A1 May 6, 2010

(30) Foreign Application Priority Data

Mar. 22, 2007 (JP) ..... 2007-074974
Mar. 22, 2007 (JP) ..... 2007-074976

(51) Int. Cl.
*H01F 1/12* (2006.01)
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 5,160,379 A * 11/1992 Yoshizawa et al. ..... 148/108
5,211,767 A 5/1993 Shigeta et al.
5,522,948 A * 6/1996 Sawa et al. ..... 148/308

FOREIGN PATENT DOCUMENTS

CN 1172862 A 2/1998
EP 1 925 686 A1 * 5/2008
JP 01-156451 A 6/1989
JP 05-140703 A 6/1993
JP 06-017204 * 1/1994
JP 06-017204 A 1/1994

(Continued)

OTHER PUBLICATIONS

Translation of Japanese Patent Document No. 06-017204.*

(Continued)

*Primary Examiner* — John P Sheehan
(74) *Attorney, Agent, or Firm* — Sughrue Mion, PLLC

(57) ABSTRACT

A soft magnetic ribbon that especially in a relatively low magnetic field region of 500 A/m or less, is high in the squareness of magnetic flux density-magnetization curve. There is disclosed a soft magnetic ribbon of 100 μm or less thickness comprising a parent phase structure in which by volume ratio, 30% or more of crystal grains of 60 nm or less (not including 0) crystal grain diameter are dispersed in an amorphous phase and comprising an amorphous layer disposed on the surface side of the parent phase structure. Preferably, the soft magnetic ribbon is represented by the composition formula $Fe_{100-x-y}Cu_xX_y$ (wherein X is at least one element selected from among B, Si, S, C, P, Al, Ge, Ga and Be), in which the atomic percents (%) satisfy the relationships $0<x\leqq5$ and $10\leqq y\leqq24$.

25 Claims, 12 Drawing Sheets

FOREIGN PATENT DOCUMENTS

| | | | | |
|---|---|---|---|---|
| JP | 2002-075718 | A | | 3/2002 |
| JP | 2004-353090 | | * | 12/2004 |
| JP | 2006-040906 | A | | 2/2006 |
| JP | 2007-270271 | A | | 10/2007 |
| WO | 2007/032531 | A1 | | 3/2007 |
| WO | WO 2007/032531 | A1 | * | 3/2007 |

OTHER PUBLICATIONS

Translation of Japanese Patent Document No. 2004-353090.*
Translation of Japanese Patent Document No. 05-263197.*
Translation of Japanese Patent Document No. 2006-040906.*
Partial translation of Chinese Office Action dated Jan. 18, 2011.

* cited by examiner

SOFT MAGNETIC RIBBON, MAGNETIC CORE, MAGNETIC PART AND PROCESS FOR PRODUCING SOFT MAGNETIC RIBBON

CROSS REFERENCE TO RELATED APPLICATIONS

This application is a National Stage of International Application No. PCT/JP2008/053798 filed Mar. 4, 2008, claiming priority based on Japanese Patent Application Nos. 2007-074974 and 2007-074976, both filed Mar. 22, 2007, the contents of all of which are incorporated herein by reference in their entirety.

TECHNICAL FIELD

The present invention relates to a soft magnetic ribbon having high saturation magnetic flux density and good squareness used for various transformers, laser power sources, pulse power magnetic parts for accelerators, various reactors, noise countermeasures, various motors, various generators, and the like, and to a magnetic core and a magnetic part using the ribbon and a process for producing the soft magnetic ribbon.

BACKGROUND ART

Silicon steels, ferrites, an amorphous alloys, a Fe-based nanocrystalline alloys, and the like are known as magnetic materials having high saturation magnetic flux density and excellent in alternating-current magnetic properties used for various transformers, reactors/choking coils, noise suppression parts, laser power sources, pulse power magnetic parts for accelerators, various motors, various generators, and the like.

The silicon steel sheet is made of an inexpensive material and has high magnetic flux density, but a problem of the silicon steel sheet is that its iron loss is large for high frequency applications. Another problem is that it is very difficult to process the silicon steel sheet to a thin sheet like an amorphous ribbon owing to the production process thereof and it is disadvantageous due to a large loss caused by a large eddy current loss. A problem of the ferrite material is its low saturation magnetic flux density and poor magnetic thermal properties. Another problem is that the ferrite, which is easily magnetically saturated, is not suitable for high power applications in which the operation magnetic flux density is high.

Further, a problem of a Co-base amorphous alloy is that it has a low saturation magnetic flux density of 1 T or less in the case of a practical material, resulting in thermal instability. For this reason, when it is used for high power applications, unfortunately, large parts are required and the iron loss increases due to a change over time. Moreover there is also a price problem because Co is expensive.

Further, a Fe-based amorphous soft magnetic alloy as described in Patent Document 1 (JP-A-05-140703 (paragraphs 0006 to 0010)) has good squareness and low coercive force and shows excellent soft magnetic properties. However, in the Fe-based amorphous alloy system, the physical upper limit of the saturation magnetic flux density is approximately 1.68 T. Furthermore, problems of the Fe-based amorphous alloy are that it has large magnetostriction and its properties deteriorate with stress and that it gives high noise in applications in which electric currents in the audio frequency band are superposed. In addition, in the conventional Fe-based amorphous soft magnetic alloys, when Fe is substantially replaced by other magnetic elements such as Co or Ni, the increase in the saturation magnetic flux density will be observed somewhat, but it is desired that the content (% by weight) of these elements be as low as possible in terms of the price. From these problems, soft magnetic materials having nanocrystals as described in Patent Document 2 (JP-A-01-156451 (from line 19 of the right upper column to line 6 of the lower right column on page 2)) are developed, and they are used for various applications.

Further, there has been disclosed a technique to produce a soft magnetic molded body having high magnetic permeability and high saturation magnetic flux density, in which an amorphous alloy having ultrafine crystals is first prepared and then annealed to produce nanocrystals, as described in Patent Document 3 (JP-A-2006-40906 (paragraphs 0040 to 0041)).

PATENT DOCUMENT 1: JP-A-05-140703 (paragraphs 0006 to 0010)

PATENT DOCUMENT 2: JP-A-01-156451 (from line 19 of the right upper column to line 6 of the lower right column on page 2)

PATENT DOCUMENT 3: JP-A-2006-40906 (paragraphs 0040 to 0041)

DISCLOSURE OF THE INVENTION

Problems to be Solved by the Invention

A soft magnetic material which has good squareness and is easily magnetized are required for core materials for a transformer, a saturable reactor, and the like. In short is, soft magnetic properties are required in which the ratio of the apparent residual magnetic flux density Br to the magnetic flux density Bm obtained in the maximum applied magnetic field Hm, i.e. Br/Bm has a high value. The Fe-based amorphous ribbon also has very useful properties in terms of the above properties, but as mentioned above, the upper limit of the saturation magnetic flux density of the Fe-based amorphous ribbon is about 1.68 T, and a soft magnetic material having higher magnetic flux density is required. Further, the silicon steel sheet has a magnetic flux density of 1.6 T or more, but it has poor saturability and has large iron loss, large eddy current loss, and high apparent power. Depending on the maximum applied magnetic field, the lower magnetic flux density Bm than that of the Fe-based amorphous ribbon occurs, and furthermore the Br/Bm also becomes low.

Thus, it is a first problem of the present invention to provide a soft magnetic ribbon which is easily magnetized and has high squareness, particularly in a relatively low magnetic field region of 500 A/m or less.

Further, it is a second problem of the present invention to provide a soft magnetic material having low loss in the high saturation magnetic flux density which solves electric power problems such as iron loss, eddy current loss, and apparent power.

Means for Solving the Problems

The soft magnetic ribbon of the present invention is characterized by comprising: a matrix where crystal grains having a crystal grain size of 60 nm or less (not including 0) are dispersed in an amorphous phase with a volume fraction of 30% or more; and an amorphous layer formed on a surface side of the matrix.

In the soft magnetic ribbon, a crystal layer comprising a crystal structure may be formed on the top surface thereof, and the amorphous layer may be formed in the inside of the crystal layer. Also, a coarse crystal grain layer containing crystals having a larger grain size than the average grain size of the crystal grains in the matrix may be formed between the amorphous layer and the matrix.

The soft magnetic ribbon of the present invention is preferably represented by the composition formula $Fe_{100-x-y}A_xX_y$, wherein A is at least one element selected from Cu and Au; X is at least one element selected from the group consisting of B, Si, S, C, P, Al, Ge, Ga, and Be; and x and y are defined by $0<x\leqq5$ and $10\leqq y\leqq24$, respectively, in atom %.

Further, the soft magnetic ribbon of the present invention provides properties in which the ratio $Br/B_{80}$ of a residual magnetic flux density Br after application of a magnetic field to a magnetic flux density $B_{80}$ in a magnetic field of 80 A/m is 90% or more, and the ribbon has good squareness.

The soft magnetic ribbon of the present invention can be used to obtain a magnetic core having an iron loss at 1.5 T and 50 Hz of 0.5 W/kg or less.

Further, the soft magnetic ribbon of the present invention has: a matrix where crystal grains having a crystal grain size of 60 nm or less (not including 0) are dispersed in an amorphous phase in the volume fraction of 30% or more, at a position of 120 nm in depth from a surface of the ribbon; and an amorphous layer formed at a depth of 120 nm or less from the surface of the ribbon.

The above soft magnetic ribbon may be a soft magnetic ribbon where a crystal layer of a crystal structure is formed on the top surface, and the amorphous layer is formed in the inside of the crystal layer.

The soft magnetic ribbon may be a soft magnetic ribbon having, between the amorphous layer and the matrix, a coarse crystal grain layer composed of crystals having a larger grain size than the average grain size of the crystal grains in the matrix.

The soft magnetic ribbon is preferably represented by the composition formula $Fe_{100-x-y}A_xX_y$, wherein A is at least one element selected from Cu and Au; X is at least one element selected from the group consisting of B, Si, S, C, P, Al, Ge, Ga, and Be; and x and y are defined by $0<x\leqq5$ and $10\leqq y\leqq24$, respectively, in atom %.

A magnetic core using such a soft magnetic ribbon provides a low loss core and is suitable for miniaturization. Therefore, a magnetic core having an iron loss of a single plate of 0.65 W/kg or less as measured at a magnetic field of 1.6 T and a frequency of 50 Hz can be provided.

A magnetic part having excellent soft magnetic properties can be obtained by using such a soft magnetic ribbon.

A process for producing the soft magnetic ribbon according to the present invention has the steps of: rapidly cooling a molten alloy containing Fe and a metalloid element to produce a Fe-based alloy having a structure where crystal grains having an average grain size of 30 nm or less (not including 0 nm) are dispersed in an amorphous phase in the volume fraction of more than 0% and less than 30%; and subjecting the Fe-based alloy to annealing to form a structure where crystal grains of a body-centered cubic structure having an average grain size of 60 nm or less are dispersed in the amorphous phase in the volume fraction of 30% or more, wherein the annealing step is conducted so that the average speed of temperature rise of 300° C. or higher is 100° C./min or more.

Advantages of the Invention

The present invention can provide a soft magnetic ribbon having high saturation magnetic flux density and low iron loss used for various transformers, laser power sources, pulse power magnetic parts for accelerators, various reactors for high current application, choking coils for active filters, smooth choking coils, noise measure parts such as electromagnetic shielding materials, motors, generators, and the like, and can provide a high-performance magnetic core and magnetic part using the same. Thus, the advantages of the present invention are significant.

BEST MODE FOR CARRYING OUT THE INVENTION

The soft magnetic ribbon of the present invention has: a matrix where crystal grains having a crystal grain size of 60 nm or less (not including 0) are dispersed in an amorphous phase in the volume fraction of 30% or more; and an amorphous layer formed on a surface side of the matrix. An example of such soft magnetic ribbons includes an alloy ribbon having a thickness of 100 μm or less which is cast by roll cooling. It has been found that the soft magnetic ribbon of the present invention as described above can provide a soft magnetic ribbon having magnetic properties which have not been obtained before this, because crystal structures different from the matrix (a crystal layer formed on the top surface, an amorphous layer, and a coarse crystal grain layer) are present in the same ribbon.

Further, although a nanocrystalline alloy generally has low toughness, the soft magnetic ribbon of the present invention has the characters that the ribbon has improved toughness by obtaining a composite structure of a nanocrystalline phase and an amorphous layer which is excellent in toughness. The amorphous layer is a portion where an amorphous state can be identified as a layer having a thickness of 10 nm or more in average on a surface side when a cross-section of a ribbon is observed. The amorphous layer is observed substantially in parallel with the surface of the ribbon. The amorphous layer does not need to be a completely continuous layer, and thus may be partially uncontinued. Since a region where crystal nuclei are deficient is formed near the surface with the appearance of the amorphous phase, coarse crystal grains having a larger crystal grain size than the average size of crystal grains in the matrix precipitate in a region adjoining the amorphous layer, easily. That is, the amorphous layer has the effect of stably precipitating the crystal layer formed on the top surface and the coarse crystal grain layer.

FIGS. 5(*a*) and 5(*b*) show an observation of a cross-section near the surface of a roll-cooled surface side of the soft magnetic ribbon of the present invention. The soft magnetic ribbon of the present invention has: a matrix D in which crystal grains having a crystal grain size of 60 nm or less (not including 0) are dispersed in an amorphous phase in the volume fraction of 30% or more, at a position deeper than 120 nm in depth from the surface of the ribbon, in a surface side of the ribbon (surface layer parts of a roll-cooled surface and a free surface at the back thereof); and an amorphous layer B formed in a surface side of the matrix D. In the above soft magnetic ribbon, a crystal layer A composed of a crystal structure is formed on the top surface, and the amorphous layer B is formed in the inside of the crystal layer A. Further, the soft magnetic ribbon may have, between the amorphous layer B and the matrix D, a coarse crystal grain layer C composed of crystal grains having a larger grain size than the average grain size of the crystal grains in the matrix. Particularly, the soft magnetic ribbon having the coarse crystal grain layer C has magnetic properties including good squareness.

Furthermore, the soft magnetic ribbon obtained by conducting the annealing step so that the average speed of temperature rise of 300° C. or higher is 100° C./min or more, has: the matrix D where crystal grains having a crystal grain size of 60 nm or less (not including 0) are dispersed in an amorphous phase in the volume fraction of 30% or more, at a depth of 120 nm from the surface 2 of the ribbon; and the amorphous layer B formed at a depth of 120 nm or less from the surface of the ribbon.

The reasons why the amorphous layer appears are deduced as follows. In this alloy system, Fe is a main component, and Cu and/or Au (hereinafter referred to as element A) is essential. Element A which does not substantially form a solid solution with Fe aggregates to form nano-order clusters, and thus aid the nucleation of crystal grains. Element A is liable to be uniformly dispersed in a portion far from the surface, thereby forming a nanocrystalline matrix D. Further, based on the properties of forming non-solid solution, element A is liable to segregate to increase the concentration of element A around the top surface, thereby forming a crystal structure in the same manner as in the matrix. On the other hand, the concentration of element A is reduced in the inner region immediately beneath the top surface because element A moves to the surface side. For this reason, an amorphous layer is formed in this region without causing the nucleation of crystal grains. In the soft magnetic ribbon of the present invention, a nanocrystal grain layer is precipitated by annealing, and the concentration of nanocrystal grain nuclei is determined by the distribution of element A, as described above. Thus, it is expected that the nuclei are difficult to be formed near the surface, thereby leading to the formation of an amorphous layer.

The elements such as Nb, Mo, Ta, and Zr, used in the conventional nanocrystalline systems have the effect of suppressing the segregation and thermal diffusion of the element A, and when such an element is contained in an excessive amount, it is difficult to obtain the amorphous layer near the surface.

The reasons why the coarse crystal grain layer C appears are deduced as follows. In a further inner region of the amorphous layer, the concentration of element A is not so high as in a region to form the matrix, and the formation of nucleation is little. The grain size of nanocrystalline grains is determined by the balance of the concentration of the nuclei and the speed of grain growth. The difference in the structure due to the difference in the speed of temperature rise does not easily appear in the region of the matrix where the concentration of element A is uniform. However, in region C where the concentration of element A is low, a slow speed of temperature rise gives sufficient time for the thermal diffusion of element A to reduce the number of the nuclei. Therefore, crystal grains are easily coarsened to form the coarse crystal grain layer C in the region C. For example, when the speed of temperature rise is increased, the crystal grains in the coarse crystal grain layer C become fine, and the average grain size is close to the average grain size of the crystal grains in the matrix. In addition, the width of the coarse crystal grain layer C is reduced. By controlling the speed of temperature rise, the structure is controlled and magnetic properties tailored to intended uses can be obtained.

As described herein "a coarse crystal grain layer C" refers to a portion having an average crystal grain size of 1.5 or more times the average size of the crystal grains in the matrix. Further, the average size of the crystal grains in the coarse crystal grain layer C is preferably two or less times the average size of the crystal grains in the matrix.

When the average size of the crystal grains in the coarse crystal grain layer is larger than two times the average size of the crystal grains in the matrix, magnetic anisotropy is increased and a magnetization process different from that of the matrix appears. For this reason, hysteresis is liable to occur between the magnetic field application process and the magnetic field elimination process. Since the structure is in the state where different phases form a composite phase, regions having different magnetization rotation mechanisms are intermingled in the structure, thereby leading to the increase in loss. When the average size of the crystal grains in the coarse crystal grain layer is 2 or less times the average size of the crystal grains in the matrix, the iron loss at 1.6 T and 50 Hz can be reduced to 0.65 W/kg or less which is lower than the iron loss of a grain-oriented silicon steel sheet. In this case, the probability of occurrence of the coarse crystal grains having a grain size of 2 or more times the average grain size of the crystal grains in the matrix can be suppressed by forming the amorphous layer in a region located at a depth of 120 nm or less from the top surface.

The average size of the crystal grains in the coarse crystal grain layer is preferably 1.9 times or less, more preferably 1.8 times or less the average size of the crystal grains in the matrix.

The soft magnetic ribbon of the present invention preferably has a thickness of 100 μm or less, more preferably 40 μm or less in order to obtain the effect of reducing eddy current loss. Further, in the present invention, "a matrix" refers to a structure composed of crystal grains and grain boundaries, where a periodically-repeated configuration has similarity and the distribution of the size of the crystal grains is uniform. In the soft magnetic ribbon, a structure near the middle point of the thickness of the ribbon is referred to as a matrix.

The crystal grain size was determined by averaging the sizes of the major axis and the minor axis of a crystal grain in the structure observed on a structural photograph obtained by an electron microscope. The crystal grain size was determined for 30 or more crystal grains, and these 30 or more values were averaged to obtain an average crystal grain size.

The volume fraction of crystal grains is determined by linear analysis. Specifically, an arbitrary straight line is assumed in a structure observed in a microscope, and the length of the test line is defined as Lt. The length Lc of the line occupied by the crystal phase is measured. The volume fraction of crystal grains is determined by determining the percentage of the length of the line occupied by the crystal grains: $L_L=L_C/L_t\times100$. Thus, the volume fraction of crystal grains $V_V$ is obtained from the equation: $V_V=L_L$.

The soft magnetic ribbon of the present invention can also provide a B—H curve of high squareness in which a ratio $Br/B_{80}$ of a residual magnetic flux density Br after application of a magnetic field to a magnetic flux density $B_{80}$ in a magnetic field of 80 A/m is 90% or more by performing annealing on specific conditions.

Further, the soft magnetic ribbon of the present invention can be used to obtain a magnetic core such as a laminated core and a tape-wound core, wherein the magnetic core has an iron loss at 1.5 T and 50 Hz of 0.5 W/kg or less. The saturation magnetic flux density is 1.65 T or more. Further, the soft magnetic ribbon of the present invention has a region providing a high magnetic flux density superior to that of the conventional grain-oriented silicon steel sheets particularly in a low magnetic field of 500 A/m or less, and the saturation magnetic flux density is higher than that of a Fe-based amorphous material. Since the properties of the squareness are improved, the apparent power can be suppressed to a low level and the flux density area is expanded.

The crystal grains are dispersed in the matrix in the volume fraction of 30% or more, preferably 50% or more, more preferably 60% or more. The average crystal grain size needs to be 60 nm or less, and a particularly desired average crystal grain size is in the range of 2 nm to 25 nm. In this range, particularly low coercive force and iron loss can be obtained.

The nanocrystal grains formed in the above-mentioned alloy have a crystal phase of a body-centered cubic structure (bcc) composed mainly of Fe, and may dissolved Si, B, Al, Ge, Zr, and the like. An ordered lattice may also be contained therein. Although the remaining part other than the crystal phase is mainly an amorphous phase, an alloy which is substantially composed of the crystal phase is also included in the present invention. A face centered cubic structure phase (fcc phase) which contains Cu and Au in part may also be present.

Further, when an amorphous phase is present in the surrounding of the crystal grains, the resistivity is high, and fine crystal grains are formed by the suppression of the grain growth. As a result, more preferred soft magnetic properties are obtained.

A lower iron loss is provided when a compound phase is not present in the above alloy, but the compound phase is also allowed to be partially contained therein.

The soft magnetic ribbon of the present invention obtained by performing the annealing step so that the speed of temperature rise of 300° C. or higher is 100° C./min or more has excellent soft magnetic properties of a saturation magnetic flux density of 1.65 T or more and an iron loss of 0.65 W/kg or less when measured at a magnetic field of 1.6 T and a frequency of 50 Hz. Therefore, the magnetic core using the same similarly has excellent characteristics, and can provide a high efficient material having low loss in the region of high magnetic flux density which is difficult to obtain by the present Fe-based material. It is possible to obtain a material having a saturation magnetic flux density of 1.70 T, and also 1.72 T.

In a silicon steel sheet, eddy current loss accounts for a large proportion of the factors of iron loss. A soft magnetic material in the form of a ribbon is advantageous because the eddy current loss increases in proportion to the square of the thickness. A silicon steel sheet has a thickness of about 230 μm or more, but the soft magnetic ribbon of the present invention has a thickness of 100 μm or less. Therefore, the eddy current loss can be reduced to ⅙ or less even when electrical resistivity is the same. In the present invention, attention is paid to a nanocrystalline material alloy ribbon containing Fe, A, and X, wherein Fe is contained in an amount of substantially 75 at. % or more wherein A is at least one element selected from Cu and Au, and X is at least one element selected from among B, Si, S, C, P, Al, Ge, Ga, and Be, and a material of high saturation density and low iron loss has been developed. A large operation flux density area and low loss can be provided by preparing a soft magnetic ribbon having 1.6 T or more of nearly the upper limit of the saturation magnetic flux density of amorphous materials as well as having an iron loss of 0.65 W/kg or less lower than an iron loss of a silicon steel sheet at 50 Hz. It is also possible to decrease the iron loss to 0.6 W/kg or less and further to 0.55 W/kg or less by the alloy composition of the soft magnetic ribbon or the annealing conditions of the soft magnetic ribbon.

The apparent power of the soft magnetic ribbon of the present invention can be suppressed to a lower degree than that of a silicon steel sheet having poor saturability. It is possible to obtain a material having a saturation magnetic flux density of 1.70 T, and also 1.72 T. The soft magnetic ribbon of the present invention is excellent in saturability and can provide an apparent power at 1.60 T and 50 Hz of, for example, 1.2 VA/kg or less. Thus, reduction of the apparent power in a high magnetic flux density region, which has been difficult in a conventional Fe-based material, can be realized, thereby providing a high efficient material.

The soft magnetic ribbon of the present invention is preferably represented by a composition formula: $Fe_{100-x-y}A_xX_y$, (wherein A is at least one element selected from Cu and Au; X is at least one element selected from the group consisting of B, Si, S, C, P, Al, Ge, Ga, and Be; and x and y are defined by $0<x\leqq 5$ and $10\leqq y\leqq 24$, respectively, in atom %). The reasons for the limitation are described below.

The amount of element A (Cu and/or Au) is 5% or less (0% is not included). Element A in the alloy composition of the present invention is particularly important. As mentioned above, element A is diffused by external factors such as annealing, mechanical oscillation, an electrical shock, and a magnetic impact or internal factors because element A does not substantially form a solid solution with Fe. In particular, when a annealing is applied in which temperature distribution and temperature difference are apt to be created between a surface and an inner part of the ribbon, the ribbon has a region where diffusion is liable to occur and a region where mutual diffusion is liable to be prevented, and the structure in the inner part changes slope wise or stepwise. In order to control a magnetic property, it is effective to control a ribbon thickness, composition, annealing temperature, annealing time, speed of temperature rise, and rate of temperature drop. The form of a B—H curve can be changed according to intended uses. It is also possible to promote diffusion of Cu atoms by the other methods such as vibration.

When the amount of the element exceeds 5%, the aggregation between elements A occurs, and therefore thermal diffusion is difficult to occur. The amount is preferably 3% or less. Further, in order to obtain the above effect, it is preferred to add the element A in an amount of 0.1 atom % or more, more preferably 0.5 atom % or more, further preferably 0.8 atom % or more. It is preferred to select Cu as the element A when material cost is taken into consideration.

Element X (X=B, Si, S, C, P, Al, Ge, Ga, and/or Be) is an indispensable element in order to form the soft magnetic ribbon of the present invention so that element A (A=Cu and/or Au) is present in the same ribbon. When the concentration of the element X is less than 10 atom %, the effect to promote the formation of an amorphous phase is insufficient. When the concentration of the element X exceeds 24 atom %, soft magnetic properties are deteriorated. Therefore, the concentration of element X is preferably in the range of 12 atom % or more and 20 atom % or less.

Particularly, the addition of B (boron) is preferable because it is an important element to promote the formation of the amorphous phase. When the concentration of B (boron) is in the range of $10\leqq y\leqq 20$ in atom %, the amorphous phase is stably obtained, while maintaining the content of Fe at a high level.

Also, the addition of Si, S, C, P, Al, Ge, Ga, and/or Be can provide high treatment temperature because the temperature at which Fe—B having a large magnetocrystalline anisotropy starts to precipitate increases. The annealing at a higher temperature increases the proportion of a nanocrystal phase, increases $B_S$, and improves the squareness of a B—H curve. In addition, the above annealing at a higher temperature is effective in the suppression of the deterioration and discoloration of the sample surface. The additive amount of Si, S, C, P, Al, Ge, Ga, Be, and/or Zr is preferably in the range of more than 0 atom % to 7 atom %. This effect is remarkably observed particularly in Si, and thus Si is preferable.

One part of Fe may be replaced by at least one element selected from Ni and Co which can form a solid solution with both Fe and element A. The above magnetic ribbon in which one part of Fe is replaced by Ni or Co increases ability for forming an amorphous phase, which allows the increase of the content of element A. The increase in the content of element A promotes the formation of a fine crystal structure to improve soft magnetic properties. Further, when one part of Fe is replaced by Ni and/or Co, saturation magnetic flux density increases. The replacement of these elements to a large extent will lead to increase in cost. Therefore, it is suitable that, in the case of Ni, the amount of replacement is less than 10%, preferably less than 5%, more preferably less than 2%. It is suitable that, in the case of Co, the amount of replacement is less than 10%, preferably less than 2%, more preferably less than 1%.

When one part of Fe is replaced by at least one element selected from the group consisting of Ti, Zr, Hf, V, Nb, Ta, Cr, Mo, W, Mn, Re, platinum group metals, Ag, Zn, In, Sn, As, Sb, Sb, Bi, Y, N, O, and rare earth elements, these elements act to aid the formation of nanocrystal grains with high Fe concentration, because these elements preferentially enter in the amorphous phase which still remains after annealing, together with element A and metalloid element. Therefore, this contributes to an improvement in soft magnetic properties. On the other hand, it is necessary to keep the content of Fe at a high level because Fe is a substantial bearer of magnetic property in the soft magnetic ribbon of the present invention. However, containing an element having a large atomic weight reduces the content of Fe per unit weight. In particular, when Fe is replaced by Nb and/or Zr, the amount of replacement is preferably about less than 5%, more preferably less than 2%. When Fe is replaced by Ta and/or Hf, the amount of replacement is preferably less than 2.5%, more preferably less than 1.2%. Further, when Fe is replaced by Mn, the saturation magnetic flux density is reduced. Therefore, the amount of replacement is preferably less than 5%, more preferably less than 2%.

However, the total amount of these elements is preferably 1.8 atom % or less, more preferably 1.0 atom % or less, in order to obtain particularly high saturation magnetic flux density.

A relatively large magnetostriction appears according to a magneto-volume effect in an amorphous alloy having the same composition as the soft magnetic ribbon of the present invention, but the magneto-volume effect is smaller in the case of Fe of a body-centered cubic structure, and the magnetostriction is also much smaller. The soft magnetic ribbon of the present invention has many structural portions composed of nanocrystal grains composed mainly of bcc Fe and is advantageous from a viewpoint of noise reduction.

For obtaining the above soft magnetic nanocrystalline alloy, it is preferred to use a production process having the steps of: rapidly cooling a molten alloy containing Fe and a metalloid element to produce a Fe-based alloy having a structure in which crystal grains having an average grain size of 30 nm or less (not including 0 nm) are dispersed in an amorphous phase in the volume fraction of more than 0% and less than 30%; and subjecting the Fe-based alloy to annealing to form a structure in which crystal grains of a body-centered cubic structure having an average grain size of 60 nm or less are dispersed in the amorphous phase in the volume fraction of 30% or more.

A molten alloy is rapidly cooled to produce a Fe-based alloy having a structure where crystal grains having an average grain size of 30 nm or less are dispersed in an amorphous phase in the volume fraction of more than 0% and less than 30%. This can suppress a significant increase in the crystal grain size even in the case of an alloy ribbon containing a large amount of Fe in which crystal grains tend to form coarse grains by annealing. Therefore, the soft magnetic alloy of the present invention has excellent soft magnetic properties while keeping a higher saturation magnetic flux density than that of conventional Fe-based nanocrystalline alloys and Fe-based amorphous alloy. Conventionally, it has been thought that when an alloy composed of a perfect amorphous phase is annealed to be crystallized, the resulting alloy will have excellent soft magnetic properties. However, as a result of intensive and extensive studies, it has been found that in an alloy containing a large amount of Fe, excellent soft magnetic properties can be realized by forming a finer crystal grain structure after annealing by producing an alloy in which fine crystal grains are dispersed in an amorphous phase (i.e. matrix) and then annealing it to proceed crystallization, rather than by simply producing a perfect amorphous alloy.

The average grain size of crystal grains dispersed in an amorphous phase before annealing needs to be 30 nm or less because when the average grain size exceeds this range, crystal grains become too large by annealing to form an uneven grain structure, which is one of the reasons of reduction of soft magnetic properties. The average grain size of crystal grains dispersed in an amorphous phase is preferably 20 nm or less. In this range, more excellent soft magnetic properties can be realized. Further, the average distance between crystal grains (distance between the centers of gravity of crystals) is typically 50 nm or less. When the average distance between crystal grains is large, crystal grain size distribution of the crystal grains after annealing becomes large. Further, crystal grains of a body-centered cubic structure dispersed in the amorphous phase after annealing have an average grain size of 60 nm or less, and they need to be dispersed therein in the volume fraction of 30% or more. This is because when the average grain size of the crystal grains exceeds 60 nm, the soft magnetic properties are reduced, and because when the volume fraction of the crystal grains is 30% or less, the high saturation magnetic flux density is difficult to obtain due to the increase of the proportion of the amorphous phase. A more preferable average crystal grain size of the crystal grains after annealing is 30 nm or less, and a more preferable volume fraction of the crystal grains is 50% or more. In these ranges, an alloy having a better soft magnetic properties and a lower magnetostriction than a Fe-based amorphous alloy can be realized.

This alloy has excellent soft magnetic properties at a saturation magnetic flux density of 1.65 T or more, further 1.7 T or more, further 1.73 T or more, and at a high saturation magnetic flux density. In addition, this alloy is also excellent in high frequency properties. The low-loss soft magnetic alloy where the iron loss at 400 Hz and 1.0 T is 7 W/kg or less, the low-loss soft magnetic alloy where the iron loss at 1 kHz and 0.5 T is 10 W/kg or less, and the low-loss soft magnetic alloy where the iron loss at 20 kHz and 0.2 T is 20 W/kg or less can be realized.

Further, the alloy can realize a soft magnetic alloy having a coercive force Hc of 200 A/m or less, further a soft magnetic alloy having a coercive force Hc of 100 A/m or less. Furthermore, the alloy can realize a soft magnetic alloy having an AC relative initial permeability $\mu_k$ of 3000 or more, further 5000 or more.

In the present invention, the processes for rapidly cooling a molten metal include a single-roll process, a twin-roll process, an in-rotating-liquid spinning process, a gas atomizing process, and a water atomizing process, and a flake, a ribbon, and a powder can be produced by using these processes. The molten metal temperature when the molten metal is rapidly cooled is desirably a temperature about 50° C. to 300° C. higher than the melting point of the alloy.

The rapid quenching method such as a single-roll process can be carried out in the air or in a local Ar atmosphere or a local nitrogen gas atmosphere when an active metal is not contained. However, when an active metal is contained, the gas atmosphere in an inert gas such as Ar or He, in a nitrogen gas or under reduced pressure, or near the roll surface at a nozzle tip part is controlled. Alternatively, the alloy ribbon production is conducted while spraying $CO_2$ gas onto a roll or while burning CO gas in the neighborhood of the roll surface near the nozzle.

The peripheral speed of the cooling roll in the case of a single-roll process is desirably in the range of about 15 m/s to about 50 m/s. A suitable material of the cooling roll is pure copper or copper alloys such as Cu—Be, Cu—Cr, Cu—Zr, and Cu—Zr—Cr having good heat conduction. When a thick ribbon or a wide ribbon is produced in a large-scale production, it is preferable that the cooling roll has a water cooled structure.

The annealing can be performed in the air, in a vacuum, or in an inert gas such as Ar, nitrogen, or helium; in particular, it is desirable to perform in an inert gas. The annealing increases the volume fraction of the crystal grains of a body-centered cubic structure mainly composed of Fe, leading to increase in saturation magnetic flux density. The annealing also reduces magnetostriction. A annealing in a magnetic field allows induced magnetic anisotropy to be imparted to the soft magnetic alloy of the present invention. The annealing in a magnetic field is conducted by applying a magnetic field having strength sufficient to be saturated in at least one part of the annealing period. Generally, although applied magnetic field is dependent on the shape of an alloy magnetic core a magnetic field of 8 $kAm^{-1}$ or more is applied when it is applied in the width direction of a ribbon (in the case of a ring core: the width direction of a ribbon is the direction of the height of the magnetic core), and a magnetic field of 80 $Am^{-1}$ or more is applied when it is applied in the longitudinal direction of a ribbon (in the case of a ring core: the longitudinal direction of a ribbon is the magnetic path direction). Any of a direct current magnetic field, an alternating current magnetic field, a repetitively pulsed magnetic field can be used as a magnetic field to be applied. The magnetic field is applied in a temperature range of 200° C. or higher for generally 20 minutes or more. Good single-axis induced magnetic anisotropy can be imparted by applying the magnetic field during temperature rise, holding a constant temperature, and cooling. Thus, a more desired direct current or alternating current hysteresis loop shape is realized. An alloy showing a direct-current hysteresis loop having a high squareness ratio or a low squareness ratio is obtained by applying annealing in a magnetic field. When the annealing in a magnetic field is not applied, the soft magnetic ribbon of the present invention shows a direct-current hysteresis loop having a moderate squareness ratio. The annealing is desirably performed in an inert gas atmosphere having a dew point of −30° C. or lower, and when the annealing is performed in an inert gas atmosphere having a dew point of −60° C. or lower, more preferred results can be obtained in which variation is further smaller. When the annealing is conducted, it is desirable that the highest arrival temperature is in the temperature range of a temperature about 70° C. high than the crystallization temperature.

When the temperature for precipitating the compound is defined as $T_{X2}$, the holding temperature is preferably $T_{X2}$−50° C. or higher. When the holding temperature is one hour or more, the above effect is hardly obtained, and this treatment time is long, thus resulting in poor productivity. Preferred holding time is 30 minutes or less, or 20 minutes or less, or 15 minutes or less. The annealing is not limited to one step, but it may be conducted in multiple steps and a plurality of times. It is also possible to pass direct current, alternating current, or pulsed current through the alloy to anneal the alloy with Joule heat, or to anneal the alloy under a stress.

By controlling the speed of temperature rise during the annealing, the width of the layer structure of the crystal phase A, the amorphous layer B, and the coarse crystal grain layer C shown in FIG. 5 can be changed, and the target B—H curve can be obtained. In order to obtain the soft magnetic ribbon of the present invention in which layers having two or more different structures are present in the same ribbon, the average speed of temperature rise at a annealing temperature of 300° C. or higher is 100° C./min or more. The annealing speed in a high temperature range gives a large influence to the properties. Further, the speed of temperature rise at a annealing temperature higher than 300° C. is preferably 130° C./min or more, more preferably 150° C./min or more.

By applying the annealing as described above, the place where the amorphous layer appears can be controlled within 120 nm from the top surface, and the target structure can be easily obtained.

By making a magnetic part from the soft magnetic ribbon having high saturation magnetic flux density and low loss, it is possible to provide a high-performance or a small magnetic part suitable for various reactors for high current applications such as anode reactors, choking coils for active filters, smooth choking coils, various transformers, noise measure parts such as magnetic shielding and electromagnetic shielding materials, laser power sources, pulse power magnetic parts for accelerators, motors, and generators.

The soft magnetic nanocrystalline alloy of the present invention can provide a more preferred result, if necessary, by subjecting it to a treatment to insulate between the ribbon layers by forming an oxide insulating layer on the alloy ribbon surface by anodic-oxidation treatment which forms an insulating layer by surface treatment using chemical conversion treatment in which the alloy ribbon surface is coated with a powder or a film of $SiO_2$, MgO, $Al_2O_3$, or the like. Such a treatment is conducted because it is particularly effective in reducing the influence of the eddy current in a high frequency region over the layers to improve the iron loss in a high frequency region. This effect is significant particularly when the treatment is used for a magnetic core constituted from a ribbon having a good surface condition and a large width. It is also possible to conduct impregnation, coating, or the like, if needed, when producing a magnetic core from the soft magnetic ribbon of the present invention. The soft magnetic ribbon of the present invention exhibits best performance particularly in an intended use for high frequency such as an intended use for flowing pulsed electric current, but it can also be used in intended uses for a sensor or a low frequency magnetic part. In particular, it can exhibit excellent properties in applications in which magnetic saturation poses a problem, and it is particularly suitable for applications of power electronics of high power.

The soft magnetic ribbon of the present invention which is annealed while applying a magnetic field in the direction substantially perpendicular to the direction of magnetization in use can provide an iron loss which is lower than that of conventional materials of high saturation magnetic flux density.

EXAMPLE 1

The ribbons, each having a width of 5 mm and a thickness of about 20 μm and each having the composition shown in Table 1 were prepared by a melt-quenching process using a single roll. The alloy ribbon was prepared by ejecting a molten alloy heated to 1300° C. onto a Cu—Be alloy roll having an outside size of 300 mm rotating at a peripheral speed of 32 m/s. As a result of an X-ray diffraction and transmission electron microscope (TEM) observation, it was found that the ribbon includes a structure dispersed in an amorphous phase in the volume fraction of less than 30%.

The ribbon was annealed so that the average rate of temperature rise at 300° C. or higher is about 200° C./min or more. The ribbon was held at a holding temperature of 450° C. for 10 minutes, and then allowed to cool to obtain the soft magnetic ribbon of the present invention.

In each sample were present a crystal layer having a thickness of about 20 nm on the top surface of the ribbon, an amorphous layer having a thickness of about 30 nm in the inside of the crystal layer, a coarse crystal grain layer having a thickness of about 50 to 60 nm in the inside of the amorphous layer, and a matrix in which fine crystal grains having an average grain size of about 20 nm were present in an amount of 80% or more, in the inner side of the coarse crystal grain layer. FIG. 1 shows magnetic flux density dependence of the iron loss of the soft magnetic ribbons of the present invention (Examples 1-1 to 1-4). Further, Table 1 shows the data on saturation magnetic flux density Bs and iron loss $P_{1.6/50}$ and $P_{1.7/50}$ measured at conditions of 50 Hz and 1.6 T and 1.7 T, respectively, for the alloy compositions of the soft magnetic ribbons of the present invention. The data of a grain-oriented silicon steel sheet is also shown for comparison. The content of a different phase was 1% or less in any composition. In particular, in Example 1-4, the iron loss $P_{1.75/50}$ at 1.75 T is 0.51 W/kg, which is about half the iron loss of a grain-oriented silicon steel sheet, even in this region.

The saturation magnetic flux density of the soft magnetic ribbon of the present invention is about 15% higher than 1.65 T which is the upper limit of the saturation magnetic flux density of a Fe-based amorphous material. The soft magnetic ribbon of the present invention has iron loss properties better than those of Fe-based amorphous materials and grain-oriented silicon steel sheets in a wide region of magnetic flux density of about 1.55 T to 1.76 T.

TABLE 1

| Name | Composition | $B_S$ (T) | Presence of amorphous layer | $P_{1.6/50}$ (W/kg) | $P_{1.7/50}$ (W/kg) |
|---|---|---|---|---|---|
| Example 1-1 | $Fe_{bal.}Cu_{1.4}Si_5B_{13}$ | 1.80 | Yes | 0.30 | 0.42 |
| Example 1-2 | $Fe_{bal.}Cu_{1.4}Si_4B_{14}$ | 1.80 | Yes | 0.33 | 0.46 |
| Example 1-3 | $Fe_{bal.}Cu_{1.4}Si_3B_{12}P_2$ | 1.82 | Yes | 0.32 | 0.37 |
| Example 1-4 | $Fe_{bal.}Cu_{1.35}Si_2B_{12}P_2$ | 1.85 | Yes | 0.36 | 0.43 |
| Grain-oriented silicon steel sheet | Fe—Si (t = 230 μm) | 1.92 | No | 0.68 | 0.81 |

EXAMPLE 2

The soft magnetic ribbon produced in Example 1 was used to measure apparent power. FIG. 2 shows the relation between the apparent power and the magnetic flux density of the soft magnetic ribbon of the present invention. Further, Table 2 shows the data on apparent power $S_{1.55/50}$, $S_{1.60/50}$, and $S_{1.65/50}$ measured at conditions of 50 Hz and 1.55 T, 1.60 T, and 1.65 T, respectively, for the alloy compositions of the soft magnetic ribbons of the present invention (Examples 1-1 to 1-4). The data of a grain-oriented silicon steel sheet is also shown for comparison.

The soft magnetic ribbon of the present invention has apparent power properties better than those of Fe-based amorphous materials and grain-oriented silicon steel sheets in a wide region of magnetic flux density of about 1.55 T to 1.7 T. These results in combination with the results in Example 1 show that the soft magnetic ribbon of the present invention has particularly excellent soft magnetic properties in the region of magnetic flux density of 1.55 T to 1.75 T.

TABLE 2

| Name | Composition | Presence of amorphous layer | $S_{1.55/50}$ (VA/kg) | $S_{1.60/50}$ (VA/kg) | $S_{1.65/50}$ (VA/kg) |
|---|---|---|---|---|---|
| Example 1-1 | $Fe_{bal.}Cu_{1.4}Si_5B_{13}$ | Yes | 0.31 | 0.35 | 0.45 |
| Example 1-2 | $Fe_{bal.}Cu_{1.4}Si_4B_{14}$ | Yes | 0.38 | 0.42 | 0.71 |
| Example 1-3 | $Fe_{bal.}Cu_{1.4}Si_3B_{12}P_2$ | Yes | 0.47 | 0.55 | 0.78 |
| Example 1-4 | $Fe_{bal.}Cu_{1.35}Si_2B_{12}P_2$ | Yes | 0.73 | 0.82 | 1.00 |
| Grain-Oriented silicon steel sheet | Fe—Si (t = 230 μm) | No | 1.01 | 1.22 | 1.54 |

EXAMPLE 3

The soft magnetic ribbon produced in Example 1 was used to measure iron loss at a frequency of 400 Hz and 1 kHz. Table 3 shows the iron loss $P_{1.0/400}$ and $P_{0.5/1\,k}$ at 1.0 T and 400 Hz, and 0.5 T and 1 kHz, respectively, of the soft magnetic ribbons of the present invention and a grain-oriented silicon steel sheet. The difference of the iron loss between the inventive materials and the grain-oriented silicon steel sheet increases with increasing frequency, showing that the inventive materials are suitable for high frequency applications. Further, FIG. 3 shows the results of the magnetic flux density dependence of iron loss for each frequency, measured by using the soft magnetic ribbons in Examples 1 to 4.

TABLE 3

| Name | Composition (Feature) | Presence of amorphous layer | $P_{1.0/400}$ (W/kg) | $P_{0.5/1k}$ (W/kg) |
|---|---|---|---|---|
| Example 1-1 | $Fe_{bal.}Cu_{1.4}Si_5B_{13}$ | Yes | 2.6 | 3.6 |
| Example 1-2 | $Fe_{bal.}Cu_{1.4}Si_4B_{14}$ | Yes | 2.7 | 3.7 |
| Example 1-3 | $Fe_{bal.}Cu_{1.4}Si_3B_{12}P_2$ | Yes | 1.9 | 1.6 |
| Example 1-4 | $Fe_{bal.}Cu_{1.35}Si_2B_{12}P_2$ | Yes | 1.8 | 1.3 |
| Grain-Oriented silicon steel sheet | Fe—Si (230 μmt) | No | 7.8 | 10.4 |

EXAMPLE 4

A ribbon having a thickness of about 20 μm and having an alloy composition of $Fe_{bal.}Cu_{1.4}Si_4B_{14}$ was prepared by a melt-quenching process using a single roll. As a result of X-ray diffraction and transmission electron microscope (TEM) observation, it was found that the ribbon includes a structure dispersed in an amorphous phase in the volume fraction of less than 30%.

The ribbon was annealed so that the average speed of temperature rise at 300° C. or higher is about 200° C./min or more. The ribbon was held at a holding temperature of 450°

C. for 10 minutes and then allowed to cool to obtain the soft magnetic ribbon of the present invention.

FIG. 4 shows a structural photograph after the annealing of the above soft magnetic ribbon. FIG. 8 is a schematic diagram of the structural photograph. FIG. 5 is a sketch showing the state of a crystal layer A, an amorphous layer B, and a coarse crystal grain layer C of the soft magnetic ribbon of the present invention. In turn from the top surface 2, there were present a crystal layer A having a thickness of about 20 nm formed on the top surface of the ribbon, an amorphous layer B having a thickness of about 30 nm formed in the inside of the crystal layer A, a layer comprising coarse crystal grains having an average grain size of 30 nm (coarse crystal grain layer C) having a thickness of about 50 to 60 nm formed in the inner side of the amorphous layer B, and a matrix D in which nanocrystal grains having an average grain size of about 25 nm were present in amount of 80% or more.

EXAMPLE 5

A minimum limit diameter $D_C$ was measured by which a soft magnetic ribbon can be bent without breakage when a single plate sample of the ribbon was bent as shown in FIG. 6. It can be determined that the smaller the limit diameter $D_C$, the better the toughness of the ribbon. Table 4 shows soft magnetic ribbons prepared as follows: the ribbons of each composition shown in the table and each having a thickness of about 20 nm were prepared by a melt-quenching process in the same manner as in Example 1, and then these ribbons were annealed so that the average rate of temperature rise at 300° C. or higher was 200° C./min or more and held at a holding temperature of 450° C. for 10 minutes. The relations between the width of the amorphous layer near the surface of the soft magnetic ribbon and the limit diameter $D_C$ are shown. Table 4 also shows the samples prepared by changing annealing conditions to increase the width of the amorphous phase thereof and limit diameters $D_C$ of the samples from which the amorphous phase has been removed by etching. It is apparent that the toughness of the sample is improved by the presence of the amorphous layer. On the other hand, when there is no amorphous layer, the ribbon is embrittled and handling thereof becomes difficult. The inventive material is characterized by low loss and high toughness of the ribbon.

TABLE 4

| Name | Width of amorphous layer (nm) | $D_G$ (mm) | Toughness |
|---|---|---|---|
| $Fe_{bal.}Cu_{1.4}Si_4B_{14}$ | 20~40 | 1 | ○ |
| $Fe_{bal.}Cu_{1.4}Si_4B_{14}$ | 40~60 | 1 or less | ○ |
| $Fe_{bal.}Cu_{1.4}Si_4B_{14}$ | 0 | 20 | X |
| $Fe_{bal.}Cu_{1.4}Si_5B_{13}$ | 20~40 | 1 | ○ |
| $Fe_{bal.}Cu_{1.4}Si_5B_{13}$ | 40~60 | 1 or less | ○ |
| $Fe_{bal.}Cu_{1.4}Si_5B_{13}$ | 0 | 20 | X |
| $Fe_{bal.}Cu_{1.4}Si_3B_{12}P_2$ | 20~40 | 1 | ○ |
| $Fe_{bal.}Cu_{1.4}Si_3B_{12}P_2$ | 40~60 | 1 or less | ○ |
| $Fe_{bal.}Cu_{1.4}Si_3B_{12}P_2$ | 0 | 15 | X |
| $Fe_{bal.}Cu_{1.35}Si_2B_{12}P_2$ | 20~40 | 1 | ○ |
| $Fe_{bal.}Cu_{1.35}Si_2B_{12}P_2$ | 40~60 | 1 or less | ○ |
| $Fe_{bal.}Cu_{1.35}Si_2B_{12}P_2$ | 0 | 20 | X |

EXAMPLE 6

A $Fe_{bal.}Cu_{1.35}Si_2B_{14}$ alloy ribbon having a thickness of about 20 μm was produced by a single-roll process. The alloy was used to produce a JIS (Japanese Industrial Standards) C12 core, which was subjected to annealing in a magnetic field. Then, high frequency properties of the core were observed. FIG. 7 shows the frequency properties of the iron loss at 0.2 T of the soft magnetic ribbon of the present invention. The data of a Fe-based amorphous sheet and an electromagnetic steel sheet is also shown for comparison. In any frequency region, iron loss P of the soft magnetic ribbon of the present invention is low, and the high frequency properties thereof are good.

EXAMPLE 7

The soft magnetic ribbons of the present invention having the compositions shown in Tables 5-1 and 5-2 were produced. The width of the soft magnetic ribbons is about 5 mm, and the thickness thereof is about 21 μm. Each of these ribbons had an amorphous layer having a thickness of 40 nm or less formed in the region of 120 nm or less from the surface of the ribbon and a matrix in which nanocrystal grains were present in an amount of 80% or more in the inner side of the amorphous layer.

Annealing temperature, saturation magnetic flux density, and the values of iron loss at 1.6 T and 50 Hz are shown. The average speed of temperature rise at 300° C. or higher was 100° C./min or 200° C./min. All of the iron losses $P_{1.6/50}$ of the resulting soft magnetic ribbons are 0.65 W/kg or less. In addition, each of the soft magnetic ribbons having the composition shown in Tables 5-1 and 5-2 has a bending limit diameter $D_C$ shown in FIG. 6 of 5 mm or less.

TABLE 5-1

| Composition | Heat treatment temperature (° C.) | Rate of temperature rise (° C./min) | Saturation magnetic flux density Bt (T) | Iron loss $P_{1.6/50}$ at 1.6 T and 50 Hz (W/kg) | Presence of amorphous layer |
|---|---|---|---|---|---|
| $Fe_{bal.}Cu_{1.3}Si_6B_{12}$ | 450 | 200 | 1.78 | 0.50 | Yes |
| $Fe_{bal.}Cu_{1.3}Si_6B_{12}$ | 450 | 100 | 1.78 | 0.55 | Yes |
| $Fe_{bal.}Cu_{1.3}Si_8B_{12}$ | 450 | 200 | 1.78 | 0.49 | Yes |
| $Fe_{bal.}Cu_{1.3}Si_8B_{12}$ | 450 | 100 | 1.78 | 0.53 | Yes |
| $Fe_{bal.}Cu_{1.3}Si_8B_{12}$ | 480 | 200 | 1.79 | 0.40 | Yes |
| $Fe_{bal.}Cu_{1.0}Si_2B_{14}$ | 450 | 200 | 1.84 | 0.55 | Yes |
| $Fe_{bal.}Cu_{1.5}Si_6B_{12}$ | 450 | 200 | 1.78 | 0.40 | Yes |
| $Fe_{bal.}Cu_{1.5}Si_5B_{13}$ | 450 | 200 | 1.78 | 0.30 | Yes |
| $Fe_{bal.}Cu_{1.6}Si_7B_{13}$ | 450 | 200 | 1.74 | 0.22 | Yes |
| $Fe_{bal.}Cu_{1.6}Si_7B_{13}$ | 470 | 200 | 1.74 | 0.29 | Yes |
| $Fe_{bal.}Cu_{1.6}Si_8B_{13}$ | 450 | 200 | 1.72 | 0.28 | Yes |
| $Fe_{bal.}Cu_{1.6}Si_8B_{13}$ | 470 | 200 | 1.72 | 0.32 | Yes |
| $Fe_{bal.}Cu_{1.6}Si_9B_{13}$ | 450 | 200 | 1.70 | 0.45 | Yes |
| $Fe_{bal.}Cu_{1.6}Si_9B_{13}$ | 470 | 200 | 1.70 | 0.45 | Yes |

TABLE 5-1-continued

| Composition | Heat treatment temperature (° C.) | Rate of temperature rise (° C./min) | Saturation magnetic flux density Bt (T) | Iron loss $P_{1.6/50}$ at 1.6 T and 50 Hz (W/kg) | Presence of amorphous layer |
|---|---|---|---|---|---|
| $Fe_{bal.}Cu_{1.25}Si_2B_{14}$ | 450 | 200 | 1.87 | 0.53 | Yes |
| $Fe_{bal.}Cu_{1.25}Si_3B_{14}$ | 450 | 200 | 1.77 | 0.53 | Yes |
| $Fe_{bal.}Cu_{1.35}Si_3B_{14}$ | 450 | 200 | 1.82 | 0.36 | Yes |
| $Fe_{bal.}Cu_{1.35}Si_3B_{14}$ | 450 | 100 | 1.82 | 0.40 | Yes |
| $Fe_{bal.}Cu_{1.5}Si_4B_{14}$ | 450 | 200 | 1.84 | 0.32 | Yes |
| $Fe_{bal.}Cu_{1.5}Si_4B_{14}$ | 450 | 100 | 1.81 | 0.32 | Yes |
| $Fe_{bal.}Cu_{1.5}Si_5B_{14}$ | 450 | 200 | 1.76 | 0.38 | Yes |
| $Fe_{bal.}Cu_{1.6}Si_6B_{14}$ | 450 | 200 | 1.74 | 0.33 | Yes |
| $Fe_{bal.}Cu_{1.6}Si_7B_{14}$ | 450 | 200 | 1.72 | 0.42 | Yes |
| $Fe_{bal.}Cu_{1.6}Si_9B_{14}$ | 450 | 200 | 1.70 | 0.48 | Yes |
| $Fe_{bal.}Cu_{1.5}Si_5B_{15}$ | 450 | 200 | 1.73 | 0.40 | Yes |
| $Fe_{bal.}Cu_{1.6}Si_6B_{15}$ | 450 | 200 | 1.70 | 0.43 | Yes |
| $Fe_{bal.}Cu_{1.6}Si_5B_{16}$ | 450 | 200 | 1.70 | 0.48 | Yes |

TABLE 5-2

| Composition | Heat treatment temperature (° C.) | Rate of temperature rise (° C./min) | Saturation magnetic flux density Bt (T) | Iron loss $P_{1.6/50}$ at 1.6 T and 50 Hz (W/kg) | Presence of amorphous layer |
|---|---|---|---|---|---|
| $Fe_{bal.}Cu_{1.35}Si_2B_{14}P_1$ | 450 | 200 | 1.79 | 0.27 | Yes |
| $Fe_{bal.}Cu_{1.35}Si_2B_{12}P_2$ | 450 | 200 | 1.82 | 0.36 | Yes |
| $Fe_{bal.}Cu_{1.4}Si_3B_{12}P_2$ | 450 | 200 | 1.79 | 0.32 | Yes |
| $Fe_{bal.}Cu_{1.4}Si_3B_{13}P_2$ | 450 | 200 | 1.77 | 0.34 | Yes |
| $Fe_{bal.}Cu_{1.5}Si_3B_{13}P_2$ | 450 | 200 | 1.72 | 0.42 | Yes |
| $Fe_{bal.}Cu_{1.5}Si_3B_{14}P_2$ | 450 | 200 | 1.71 | 0.42 | Yes |
| $Fe_{bal.}Cu_{1.0}Au_{0.25}B_{15}Si_1$ | 480 | 200 | 1.84 | 0.48 | Yes |
| $Fe_{bal.}Ni_2Cu_{1.25}B_{14}Si_2$ | 450 | 200 | 1.81 | 0.31 | Yes |
| $Fe_{bal.}Co_2Cu_{1.25}B_{14}Si_2$ | 470 | 200 | 1.82 | 0.32 | Yes |
| $Fe_{bal.}Cu_{1.35}B_{14}Si_3Al_{0.5}$ | 450 | 200 | 1.80 | 0.45 | Yes |
| $Fe_{bal.}Cu_{1.35}B_{14}Si_3P_{0.5}$ | 470 | 200 | 1.79 | 0.42 | Yes |
| $Fe_{bal.}Cu_{1.35}B_{14}Si_3Ge_{0.5}$ | 450 | 200 | 1.80 | 0.41 | Yes |
| $Fe_{bal.}Cu_{1.35}B_{14}Si_3C_{0.5}$ | 470 | 200 | 1.80 | 0.45 | Yes |
| $Fe_{bal.}Cu_{1.35}B_{14}Si_3Au_{0.5}$ | 450 | 200 | 1.81 | 0.35 | Yes |
| $Fe_{bal.}Cu_{1.35}B_{14}Si_3Pt_{0.5}$ | 450 | 200 | 1.81 | 0.36 | Yes |
| $Fe_{bal.}Cu_{1.35}B_{14}Si_3W_{0.5}$ | 450 | 200 | 1.79 | 0.36 | Yes |
| $Fe_{bal.}Cu_{1.35}B_{14}Si_3Sn_{0.5}$ | 450 | 100 | 1.80 | 0.36 | Yes |
| $Fe_{bal.}Cu_{1.35}B_{14}Si_3In_{0.5}$ | 450 | 200 | 1.80 | 0.37 | Yes |
| $Fe_{bal.}Cu_{1.35}B_{14}Si_3Ga_{0.5}$ | 450 | 100 | 1.81 | 0.36 | Yes |
| $Fe_{bal.}Cu_{1.35}B_{14}Si_3Ni_{0.5}$ | 450 | 200 | 1.81 | 0.35 | Yes |
| $Fe_{bal.}Cu_{1.35}B_{14}Si_3Hf_{0.5}$ | 450 | 200 | 1.78 | 0.36 | Yes |
| $Fe_{bal.}Cu_{1.35}B_{14}Si_3Nb_{0.5}$ | 450 | 200 | 1.78 | 0.34 | Yes |
| $Fe_{bal.}Cu_{1.35}B_{14}Si_3Zr_{0.5}$ | 450 | 200 | 1.78 | 0.35 | Yes |
| $Fe_{bal.}Cu_{1.35}B_{14}Si_3Ta_{0.5}$ | 450 | 200 | 1.78 | 0.35 | Yes |
| $Fe_{bal.}Cu_{1.35}B_{14}Si_3Mo_{0.5}$ | 450 | 200 | 1.78 | 0.36 | Yes |
| $Fe_{bal.}Cu_{1.35}B_{16}Si_3Ge_{0.5}$ | 450 | 200 | 1.80 | 0.42 | Yes |
| $Fe_{bal.}Cu_{1.4}Nb_{0.025}B_{14}Si_1$ | 450 | 200 | 1.85 | 0.48 | Yes |
| $Fe_{bal.}Cu_{1.55}V_{0.2}Si_{14.5}B_8$ | 450 | 200 | 1.77 | 0.39 | Yes |
| $Fe_{bal.}Cu_{1.8}Si_4B_{13}Zr_{0.2}$ | 450 | 200 | 1.81 | 0.34 | Yes |

EXAMPLE 8

A molten alloy having an alloy composition of $Fe_{bal.}Cu_{1.25}Si_2B_{14}$ (atom %) heated to 1250° C. was ejected from a slit shape nozzle onto a rotating Cu—Be alloy roll having an outer diameter of about 300 mm to produce alloy ribbons each having a width of 5 mm and having a different crystal grain volume fraction in the amorphous phase, and the crystal grain volume fraction was determined from a transmission electron microscope image. Next, this alloy ribbon was wound to produce a tape-wound core having an outer diameter of 19 mm and an inner diameter of 15 mm, which was annealed for one hour at 410° C. to measure saturation magnetic flux density Bs and coercive force Hc after annealing. The crystal grain volume fraction of the alloy after annealing was 30% or more, and Bs was in the range from 1.8 T to 1.87 T.

Table 6 shows Hc after the annealing. When the alloy in which crystal grains are not present in the alloy before annealing was heat-treated so that the amorphous phase after the annealing contains the crystal grains in an amount of 60%, the coercive force Hc of the resulting alloy was a significantly large value of 750 A/m. When the alloy having a crystal grain volume fraction of 30% or less in the amorphous phase before annealing was annealed, the coercive force Hc of the alloy after the annealing was small. Thus, it was verified that an alloy with high Bs and excellent in soft magnetic properties can be provided by the inventive production method. On the other hand, it was found that in the case of the alloy prepared by annealing an alloy having a crystal grain volume fraction of 30% or more in the amorphous phase before annealing so as to crystallize the remaining amorphous phase, coarse crystal grains were produced in the alloy, and the alloy showed a tendency to increase the coercive force Hc.

As described above, when a high Bs alloy containing a large amount of Fe, which has a structure in which fine crystals are dispersed in an amount of more than 0% and less than 30% in the state where a quenched state before annealing is maintained, is annealed to further advance crystallization, the resulting alloy has soft magnetic properties better than that of a completely amorphous alloy or an alloy in which crystal grains are present in an amount of 30% or more.

TABLE 6

| Crystal grain volume fraction amarphous phase (before heat treatment) (%) | Hc (A/m) |
|---|---|
| 0 | 750 |
| 3 | 6.4 |
| 4.5 | 6.0 |
| 10 | 6.3 |
| 27 | 7.2 |
| 34 | 70 |
| 53 | 120 |
| 60 | 250.3 |

EXAMPLE 9

A $Fe_{bal}Cu_{1.5}Si_4B_{14}$ alloy ribbon having a thickness of about 20 μm was prepared by a melt-quenching process by ejecting a molten alloy heated to 1300° C. onto a Cu—Be alloy single roll having an outer diameter of 300 mm rotating at a peripheral speed of 32 m/s. As a result of X-ray diffraction and transmission electron microscope (TEM) observation, it was found that the ribbon includes a structure in which fine crystals are dispersed in an amorphous phase in the volume fraction of less than 30%.

The alloy ribbon was annealed. The patterns of the annealing were as follows: the average speed of temperature rise over 300° C. to the highest temperature was less than 100° C./min or about 200° C./min. In both patterns, the ribbons were held at a holding temperature of 450° C. for 10 minutes in the annealing and then allowed to cool to obtain the soft magnetic ribbons of the present invention.

FIG. 9 shows a structural photograph near the ribbon surface of the soft magnetic ribbon (1-1) of the present invention by a transmission electron microscope, in which the average speed of temperature rise at 300° C. or higher during annealing is less than 100° C./min. The schematic diagram thereof is shown in FIG. 14. The structure has, in turn from the top surface, a nanocrystalline grain layer A, an amorphous layer B, a coarse crystal grain layer C composed of coarsened crystal grains having about twice the average crystal grain of the crystals in a matrix D, and a matrix D. In the matrix, nanocrystal grains having an average grain size of about 25 nm were present in an amount of 80% or more. When the soft magnetic ribbon (1-1) is annealed, a coarse crystal grain layer is easily precipitated near the surface by controlling the average speed of temperature rise at 300° C. or higher to less than 100° C./min. In turn from the top surface, a nanocrystalline grain layer A, an amorphous phase B, and a small amount of a coarse crystal grain layer C are observed. A matrix D is observed in the inner side of the coarse crystal grain layer C.

Further, for comparison, alloy ribbons each having a thickness of about 20 μm and a composition formula of $Fe_{bal}Cu_{1.5}Si_4B_{14}Nb_5$ or $Fe_{bal}Cu_{1.0}B_6Nb_{3.5}$ were prepared by a melt-quenching process by ejecting a molten alloy heated to 1300° C. onto a Cu—Be alloy single roll having an outer diameter of 300 mm rotating at a peripheral speed of 32 m/s. Although the surface of these alloy ribbons was observed similarly, an amorphous layer like in the present application was not observed, but a nanocrystalline alloy having substantially the same size as a whole was observed as shown in a schematic diagram in FIG. 15.

EXAMPLE 10

FIG. 10 shows a B-H curve of the soft magnetic ribbon (1-1) of the present invention at a maximum magnetic field $B_m$ of 80 A/m. In addition, a dotted line shows a B-H curve of the soft magnetic ribbon (1-2) in which the composition is the same and an average speed of temperature rise at 300° C. or higher is 200° C/min. The B-H curve of the soft magnetic ribbon having a lower speed of temperature rise (1-1) has a squareness better than the soft magnetic ribbon having a higher speed of temperature rise (1-2), and the ratio $B_r/B_{80}$ is a high value of about 94%. In addition, a large magnetic flux density is obtained in a low magnetic field. In the soft magnetic ribbon having a higher speed of temperature rise (1-2), the ratio $B_r/B_{80}$ indicating squareness is about 67%, which is not easily saturated in a lower field. FIG. 11 shows a B-H curve of the above two samples when $B_m$ is 800 A/m. Although B800 is about 1.8 T, which is comparable, but a large difference appears in the hysteresis of the B-H curve in the region of 1.5 T or more. In the soft magnetic ribbon having a lower speed of temperature rise during annealing (1-1), a hysteresis is present up to a magnetic field region of 500 A/m in the region of 1.5 T or more. On the other hand, in the soft magnetic ribbon having a higher speed of temperature rise (1-2), the hysteresis is smaller in the region of this magnetic flux density. The hysteresis is generally a loss and smaller hysteresis is desired, but depending on the magnetic field and the region of magnetic flux density to be used, squareness may become important. From the comparison of FIG. 10 and FIG. 11, it is found that there is a close relation between the occurrence of a hysteresis in the region of 1.5 T or more and the squareness of a minor loop. As described above, it is possible to control the shape of the B-H curve by controlling the average speed of temperature rise at 300° C. or higher.

EXAMPLE 11

A $Fe_{bal}Cu_{1.35}Si_2B_{14}$ alloy ribbon having a thickness of about 18 μm was produced by a melt-quenching process. The conditions for producing the alloy ribbon were substantially the same as in Example 9, and it was verified that the resulting alloy ribbon had a structure in which fine crystals were dispersed in an amorphous phase in the volume fraction of less than 30%. When this alloy ribbon was subjected to annealing so that the speed of temperature rise at 300° C. was less than 100° C./min, a soft magnetic ribbon (2-1) having substantially the same structure as that of the soft magnetic ribbon (1-1) in Example 9 was obtained. The B—H curve of this soft magnetic ribbon (2-1) is shown in FIG. 12. This B—H curve is substantially the same B—H curve as that of the soft magnetic ribbon (1-1) in FIG. 10, wherein a large B was obtained as $B_{80}$=1.7 T, and also a large squareness value was obtained as $B_r/B_{80}$=94%.

EXAMPLE 12

The soft magnetic ribbons of the alloy compositions shown in Table 7 were produced in substantially the same manner as in Example 11. The squareness ratios Br/B8000 and Br/B80 of these soft magnetic ribbons are shown. As shown in Table 7, the soft magnetic ribbons of the present invention have an amorphous layer. The ribbons No. 4-1 to No. 4-12 prepared by reducing the speed of temperature rise in the annealing have high Br/B80 values of 90% or more, indicating that squareness is good. In addition, there is a difference of about 5 to 20% between Br/B8000 and Br/B80, and a difference in squareness appears between the case where a minor loop is drawn and the case where a full loop is drawn. When a layer comprising coarse crystal grains having a size about twice the average grain size of the crystal grains in the matrix is precipitated near the ribbon surface by controlling the structure, the shape of the B-H loop changes and squareness is improved. As shown in Table 7, even when the composition is the same, a large difference appears in squareness by the presence of the coarse crystal grain layer. The ribbon utilizing such a phenomenon is promising as a switching element using the difference in the magnetic field region.

TABLE 7

| No. | Composition | Rate of temperature rise (° C./min) | Prsence of amorphous layer | $B_r/B_{8000}$ (%) | $B_r/B_{80}$ (%) |
|---|---|---|---|---|---|
| 4-1 | $Fe_{bal}Cu_{1.5}Si_4B_{14}$ | 70 | Yes | 86.0 | 93.9 |
| 4-2 | $Fe_{bal}Cu_{1.35}Si_2B_{14}$ | 70 | Yes | 89.2 | 94.3 |
| 4-3 | $Fe_{bal}Cu_{1.5}Si_4B_{12}$ | 70 | Yes | 90.7 | 95.6 |
| 4-4 | $Fe_{bal}Cu_{1.5}Si_6B_{12}$ | 70 | Yes | 84.2 | 96.5 |
| 4-5 | $Fe_{bal}Cu_{1.5}Si_8B_{12}$ | 70 | Yes | 77.2 | 98.7 |
| 4-6 | $Fe_{bal}Cu_{1.35}Si_5B_{13}$ | 70 | Yes | 89.7 | 96.8 |
| 4-7 | $Fe_{bal}Cu_{1.35}Si_5B_{14}$ | 70 | Yes | 85.9 | 94.0 |
| 4-8 | $Fe_{bal}Cu_{1.35}Si_5B_{15}$ | 70 | Yes | 89.7 | 96.3 |
| 4-9 | $Fe_{bal}Cu_{1.5}Si_5B_{14}$ | 70 | Yes | 89.3 | 96.7 |
| 4-10 | $Fe_{bal}Cu_{1.5}Si_5B_{15}$ | 70 | Yes | 88.1 | 98.3 |
| 4-11 | $Fe_{bal}Cu_{1.5}Si_4B_{13}$ | 70 | Yes | 88.9 | 96.0 |
| 4-12 | $Fe_{bal}Cu_{1.5}Si_5B_{13}$ | 70 | Yes | 86.2 | 94.3 |
| 4-13 | $Fe_{bal}Cu_{1.5}Si_4B_{14}$ | 200 | Yes | 61.1 | 67.2 |
| 4-14 | $Fe_{bal}Cu_{1.5}Si_4B_{12}$ | 200 | Yes | 84.2 | 85.6 |
| 4-15 | $Fe_{bal}Cu_{1.35}Si_5B_{13}$ | 200 | Yes | 78.8 | 80.7 |
| 4-16 | $Fe_{bal}Cu_{1.35}Si_5B_{15}$ | 200 | Yes | 68.0 | 68.1 |

EXAMPLE 13

A $Fe_{bal}Cu_{1.5}Si_4B_{14}$ alloy ribbon (No. 4-1 in Table 7) and a $Fe_{bal}Cu_{1.35}Si_2B_{14}$ alloy ribbon (No. 4-2 in Table 7) which have a thickness of about 18 to 20 μm were produced by a melt-quenching process. The conditions for producing the alloy ribbons were substantially the same as in Example 9, and it was verified that the resulting alloy ribbons had a structure in which fine crystals were dispersed in an amorphous phase in the volume fraction of less than 30%. When these alloy ribbons were subjected to annealing so that the average speed of temperature rise at 300° C. or higher was less than 100° C./min, soft magnetic ribbons having substantially the same structure as that of the soft magnetic ribbon (1-1) in Example 9 were obtained.

FIG. 13 shows magnetic field dependence $P_{1.5/50}$ and $P_{1.55/50}$ (showing the iron loss at 1.5 T and 1.55 T at 50 Hz, respectively) of the apparent power in the soft magnetic ribbons of the present invention (No. 4-1 and 4-2 in Table 7). The data of the soft magnetic ribbon (No. 4-13 in Table 7) of the same composition in the case where the average rate of temperature rise at 300° C. or higher is 200° C./min are also indicated. Both the data of a grain-oriented silicon steel sheet and a Fe-based amorphous material are also shown for comparison.

Further, Table 8 shows the iron loss $P_{1.5/50}$ and $P_{1.55/50}$ and the apparent power $S_{1.5/50}$ and $S_{1.55/50}$ at 1.5 T and 1.55 T at 50 Hz, respectively. Although the inventive material has a higher apparent power than the Fe-based amorphous material in a lower magnetic field, it has a lower apparent power than both the Fe-based amorphous material and the silicon steel sheet in the region of about 1.5 T or more and less than 1.7 T. Particularly, the soft magnetic ribbon (No. 4-2) of the present invention has the lowest iron loss and apparent power in the region of 1.6 to 1.7 T, including: $P_{1.6/50}$=0.35, $P_{1.65/50}$=0.41, $S_{1.6/50}$=0.42, and $S_{1.65/50}$=0.53. Further, when the soft magnetic ribbon No. 4-1 in which a coarse crystal grain layer is present is compared with the soft magnetic ribbon No. 4-13 which has the same composition as the ribbon No. 4-1 but has no coarse crystal grain layer, the soft magnetic ribbon No. 4-1 in which a coarse crystal grain layer is present has a lower apparent power in the region of 1.4 to 1.6 T. The inventive ribbon has a saturation magnetic flux density of about 15% higher than that of the Fe-based amorphous material, the saturation magnetic flux density being 1.8 T or more. In addition, since the inventive ribbon has better saturability than that of the silicon steel sheet, the region in which the inventive ribbon exhibits better apparent power properties than the silicon steel sheet is present in the region of 1.4 T B, and such a ribbon is advantageous as a soft magnetic material.

TABLE 8

| | Composition | Average grain size in coarse crystal grain layer | $P_{1.5/50}$ (W/kg) | $P_{1.55/50}$ (W/kg) | $S_{1.5/50}$ (VA/kg) | $S_{1.55/50}$ (VA/kg) |
|---|---|---|---|---|---|---|
| 4-1 | $Fe_{bal}Cu_{1.5}Si_4B_{14}$ | 40 nm | 0.26 | 0.32 | 0.33 | 0.48 |
| 4-2 | $Fe_{bal}Cu_{1.35}Si_2B_{14}$ | 40 nm | 0.30 | 0.32 | 0.34 | 0.37 |
| 4-13 | $Fe_{bal}Cu_{1.5}Si_4B_{14}$ | 30 nm | 0.27 | 0.29 | 0.43 | 0.56 |
| Comparative Example 1 | Grain-oriented silicon steel sheet 3% Si | — | 0.59 | 0.63 | 0.94 | 1.06 |
| Comparative Example 2 | Fe-based amorphous material | — | 0.11 | 0.14 | 0.36 | 8.90 |

Tables 9-1 and 9-2 show the dependence of the magnetic flux density and the squareness ratio $B_r/B_{80}$ on the annealing temperature and the rate of temperature rise for various compositions. Each ribbon has a width of about 5 mm and a thickness of about 21 μm. All compositions in the following tables provide a squareness ratio $B_r/B_{80}$ of 90% or more.

TABLE 9-1

| Composition | Heat treatment temperature (° C.) | Rate of temperature rise (° C./min) | Saturation magnetic flux density $B_S$ (T) | Iron loss at 1.5 T and 50 Hz $P_{1.5/50}$ (w/kg) | Squareness ratio $B_r/B_{80}$ (%) | Presence of amorphous layer |
|---|---|---|---|---|---|---|
| $Fe_{bal.}Cu_{1.3}Si_6B_{12}$ | 420 | 70 | 1.78 | 0.46 | 91 | Yes |
| $Fe_{bal.}Cu_{1.3}Si_6B_{12}$ | 420 | 50 | 1.78 | 0.49 | 92 | Yes |
| $Fe_{bal.}Cu_{1.3}Si_8B_{12}$ | 420 | 70 | 1.78 | 0.45 | 91 | Yes |
| $Fe_{bal.}Cu_{1.3}Si_8B_{12}$ | 420 | 50 | 1.78 | 0.48 | 93 | Yes |
| $Fe_{bal.}Cu_{1.3}Si_8B_{12}$ | 440 | 70 | 1.79 | 0.36 | 91 | Yes |
| $Fe_{bal.}Cu_{1.0}Si_2B_{14}$ | 420 | 70 | 1.84 | 0.49 | 94 | Yes |
| $Fe_{bal.}Cu_{1.5}Si_6B_{12}$ | 420 | 70 | 1.78 | 0.36 | 97 | Yes |
| $Fe_{bal.}Cu_{1.5}Si_5B_{13}$ | 420 | 70 | 1.78 | 0.26 | 94 | Yes |
| $Fe_{bal.}Cu_{1.6}Si_7B_{13}$ | 420 | 70 | 1.74 | 0.21 | 92 | Yes |
| $Fe_{bal.}Cu_{1.6}Si_7B_{13}$ | 430 | 70 | 1.74 | 0.26 | 93 | Yes |
| $Fe_{bal.}Cu_{1.6}Si_8B_{13}$ | 420 | 70 | 1.72 | 0.25 | 94 | Yes |
| $Fe_{bal.}Cu_{1.6}Si_8B_{13}$ | 430 | 70 | 1.72 | 0.28 | 95 | Yes |
| $Fe_{bal.}Cu_{1.6}Si_9B_{13}$ | 420 | 70 | 1.70 | 0.41 | 91 | Yes |
| $Fe_{bal.}Cu_{1.6}Si_9B_{13}$ | 430 | 70 | 1.70 | 0.41 | 92 | Yes |
| $Fe_{bal.}Cu_{1.25}Si_2B_{14}$ | 420 | 70 | 1.87 | 0.49 | 94 | Yes |
| $Fe_{bal.}Cu_{1.25}Si_3B_{14}$ | 420 | 70 | 1.77 | 0.49 | 94 | Yes |
| $Fe_{bal.}Cu_{1.35}Si_3B_{14}$ | 420 | 70 | 1.82 | 0.32 | 92 | Yes |
| $Fe_{bal.}Cu_{1.35}Si_3B_{14}$ | 420 | 50 | 1.82 | 0.36 | 95 | Yes |
| $Fe_{bal.}Cu_{1.5}Si_4B_{14}$ | 420 | 70 | 1.84 | 0.28 | 91 | Yes |
| $Fe_{bal.}Cu_{1.5}Si_4B_{14}$ | 420 | 50 | 1.84 | 0.28 | 94 | Yes |
| $Fe_{bal.}Cu_{1.5}Si_5B_{14}$ | 420 | 70 | 1.76 | 0.34 | 97 | Yes |
| $Fe_{bal.}Cu_{1.6}Si_6B_{14}$ | 420 | 70 | 1.74 | 0.29 | 92 | Yes |
| $Fe_{bal.}Cu_{1.6}Si_7B_{14}$ | 420 | 70 | 1.72 | 0.38 | 94 | Yes |
| $Fe_{bal.}Cu_{1.6}Si_9B_{14}$ | 420 | 70 | 1.70 | 0.44 | 92 | Yes |
| $Fe_{bal.}Cu_{1.5}Si_5B_{15}$ | 420 | 70 | 1.73 | 0.36 | 98 | Yes |
| $Fe_{bal.}Cu_{1.6}Si_6B_{15}$ | 420 | 70 | 1.70 | 0.39 | 92 | Yes |
| $Fe_{bal.}Cu_{1.6}Si_5B_{16}$ | 420 | 70 | 1.70 | 0.44 | 91 | Yes |

TABLE 9-2

| Composition | Heat treatment temperature (° C.) | Rate of temperature rise (° C./min) | Saturation magnetic flux density $B_S$ (T) | Iron loss at 1.5 T and 50 Hz $P_{1.5/50}$ (W/kg) | Squareness ratio $B_r/B_{80}$ (%) | Presence of amorphous layer |
|---|---|---|---|---|---|---|
| $Fe_{bal.}Cu_{1.35}Si_2B_{14}P_1$ | 420 | 70 | 1.79 | 0.25 | 91 | Yes |
| $Fe_{bal.}Cu_{1.35}Si_2B_{12}P_2$ | 420 | 70 | 1.82 | 0.32 | 93 | Yes |
| $Fe_{bal.}Cu_{1.4}Si_3B_{12}P_2$ | 420 | 70 | 1.79 | 0.28 | 91 | Yes |
| $Fe_{bal.}Cu_{1.4}Si_3B_{13}P_2$ | 420 | 70 | 1.77 | 0.30 | 91 | Yes |
| $Fe_{bal.}Cu_{1.5}Si_3B_{13}P_2$ | 420 | 70 | 1.72 | 0.38 | 92 | Yes |
| $Fe_{bal.}Cu_{1.5}Si_3B_{14}P_2$ | 420 | 70 | 1.71 | 0.38 | 94 | Yes |
| $Fe_{bal.}Cu_{1.0}Au_{0.25}B_{15}Si_1$ | 440 | 70 | 1.84 | 0.44 | 94 | Yes |
| $Fe_{bal.}Ni_2Cu_{1.25}B_{14}Si_2$ | 420 | 70 | 1.81 | 0.27 | 91 | Yes |
| $Fe_{bal.}Co_2Cu_{1.25}B_{14}Si_2$ | 430 | 70 | 1.82 | 0.28 | 93 | Yes |
| $Fe_{bal.}Cu_{1.35}B_{14}Si_3Al_{0.5}$ | 420 | 70 | 1.80 | 0.41 | 95 | Yes |
| $Fe_{bal.}Cu_{1.35}B_{14}Si_3P_{0.5}$ | 430 | 70 | 1.79 | 0.38 | 95 | Yes |
| $Fe_{bal.}Cu_{1.35}B_{14}Si_3Ge_{0.5}$ | 420 | 70 | 1.80 | 0.37 | 94 | Yes |
| $Fe_{bal.}Cu_{1.35}B_{14}Si_3C_{0.5}$ | 430 | 70 | 1.80 | 0.41 | 91 | Yes |
| $Fe_{bal.}Cu_{1.35}B_{14}Si_3Au_{0.5}$ | 420 | 70 | 1.81 | 0.31 | 92 | Yes |
| $Fe_{bal.}Cu_{1.35}B_{14}Si_3Pt_{0.5}$ | 420 | 70 | 1.81 | 0.32 | 94 | Yes |
| $Fe_{bal.}Cu_{1.35}B_{14}Si_3W_{0.5}$ | 420 | 70 | 1.79 | 0.32 | 94 | Yes |
| $Fe_{bal.}Cu_{1.35}B_{14}Si_3Sn_{0.5}$ | 420 | 50 | 1.80 | 0.32 | 92 | Yes |
| $Fe_{bal.}Cu_{1.35}B_{14}Si_3In_{0.5}$ | 420 | 70 | 1.80 | 0.33 | 92 | Yes |
| $Fe_{bal.}Cu_{1.35}B_{14}Si_3Ga_{0.5}$ | 420 | 50 | 1.81 | 0.32 | 93 | Yes |
| $Fe_{bal.}Cu_{1.35}B_{14}Si_3Ni_{0.5}$ | 420 | 70 | 1.81 | 0.32 | 92 | Yes |
| $Fe_{bal.}Cu_{1.35}B_{14}Si_3Hf_{0.5}$ | 420 | 70 | 1.78 | 0.32 | 94 | Yes |
| $Fe_{bal.}Cu_{1.35}B_{14}Si_3Nb_{0.5}$ | 420 | 70 | 1.78 | 0.30 | 91 | Yes |
| $Fe_{bal.}Cu_{1.35}B_{14}Si_3Zr_{0.5}$ | 420 | 70 | 1.78 | 0.31 | 91 | Yes |
| $Fe_{bal.}Cu_{1.35}B_{14}Si_3Ta_{0.5}$ | 420 | 70 | 1.78 | 0.31 | 93 | Yes |
| $Fe_{bal.}Cu_{1.35}B_{14}Si_3Mo_{0.5}$ | 420 | 70 | 1.78 | 0.32 | 93 | Yes |
| $Fe_{bal.}Cu_{1.35}B_{16}Si_3Ge_{0.5}$ | 420 | 70 | 1.80 | 0.38 | 93 | Yes |
| $Fe_{bal.}Cu_{1.4}Nb_{0.025}B_{14}Si_1$ | 420 | 70 | 1.85 | 0.45 | 95 | Yes |
| $Fe_{bal.}Cu_{1.55}V_{0.2}Si_{14.5}B_8$ | 420 | 70 | 1.77 | 0.35 | 91 | Yes |
| $Fe_{bal.}Cu_{1.8}Si_4B_{13}Zr_{0.2}$ | 420 | 70 | 1.81 | 0.30 | 93 | Yes |

INDUSTRIAL APPLICABILITY

By constituting a magnetic part from the soft magnetic ribbon having high saturation magnetic flux density and low loss, it is possible to provide a high-performance or a small magnetic part suitable for various reactors for high current applications such as anode reactors, choking coils for active filters, smooth choking coils, various transformers, noise measure parts such as magnetic shielding and electromagnetic shielding materials, laser power sources, pulse power magnetic parts for accelerators, motors, and generators.

DESCRIPTION OF REFERENCE NUMERALS

Figure 1:
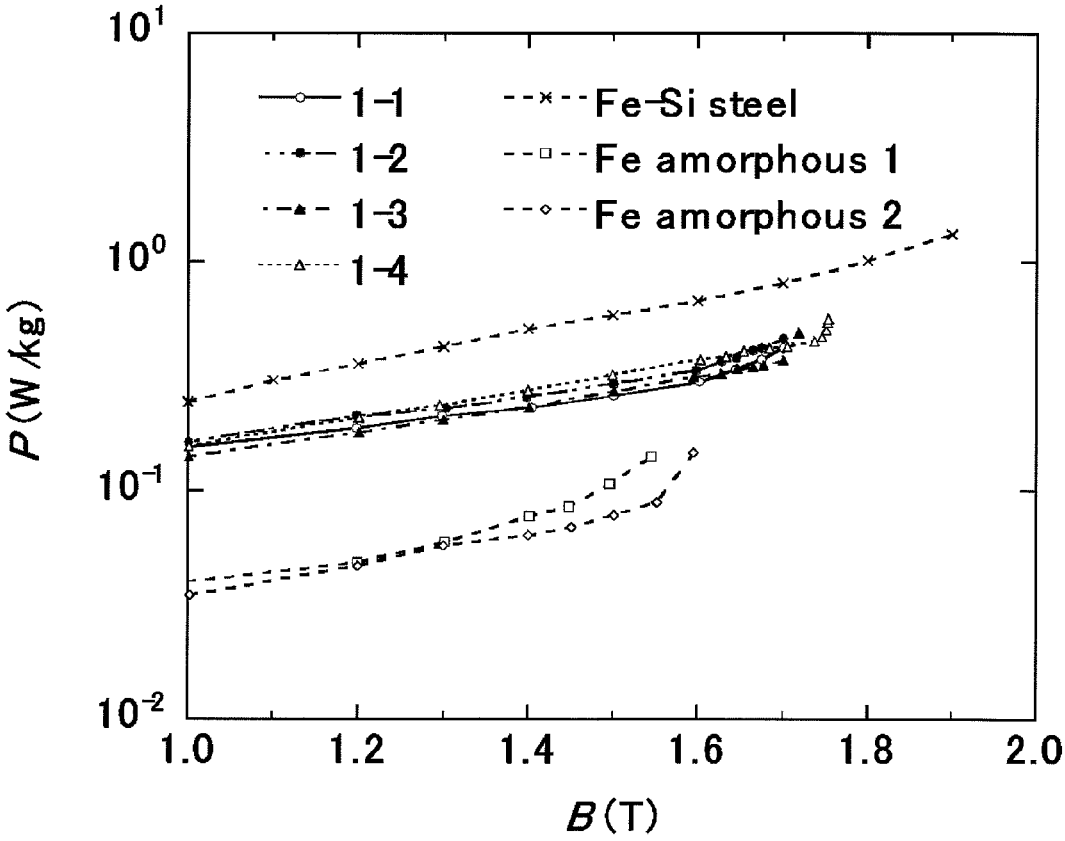
FIG. 1 shows the magnetic flux density dependence of the iron loss at 50 Hz.
Figure 2:
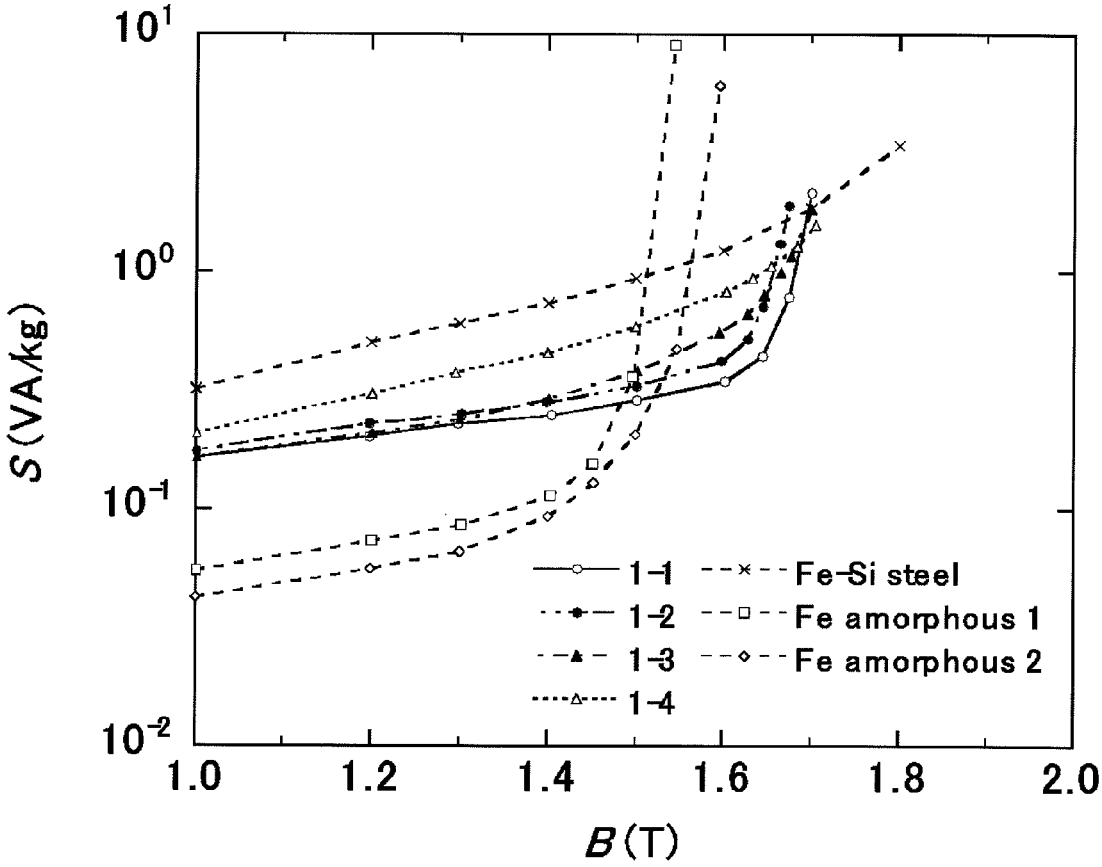
FIG. 2 shows the magnetic flux density dependence of the apparent power at 50 Hz.
Figure 3:
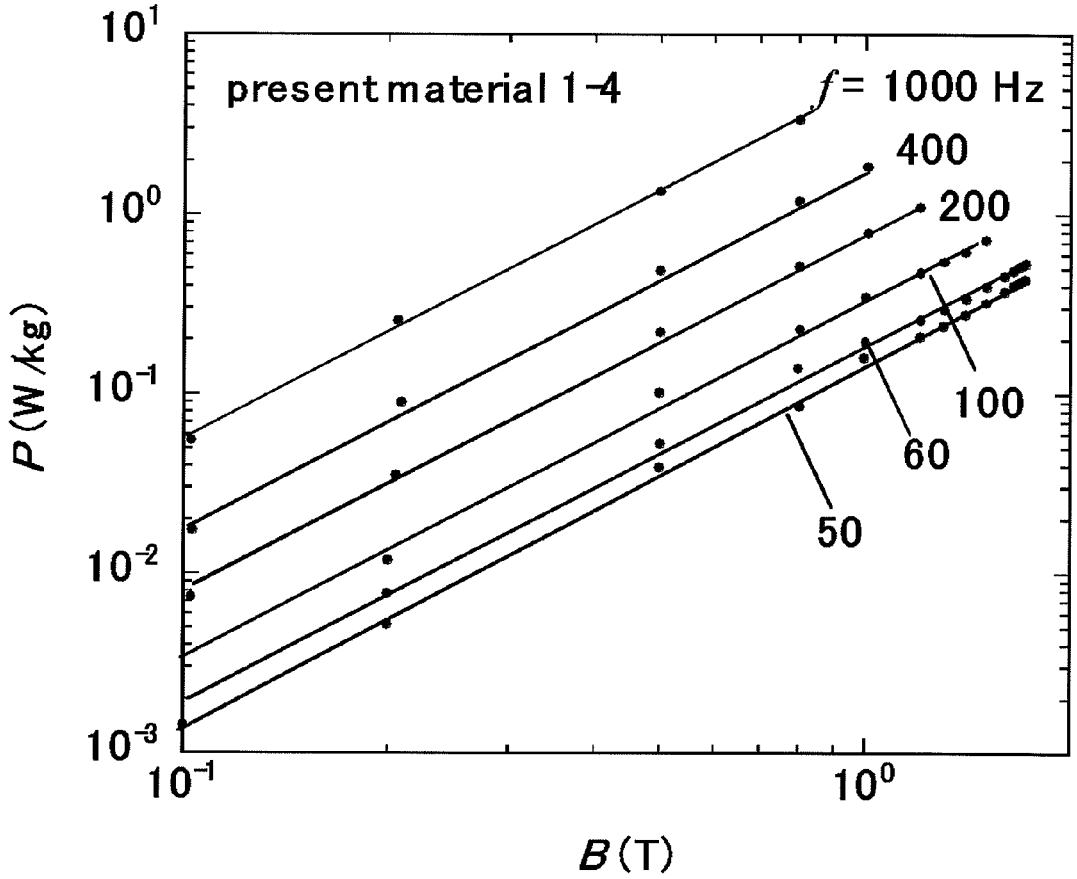
FIG. 3 shows the magnetic flux density dependence of the iron loss at each frequency.
Figure 4:
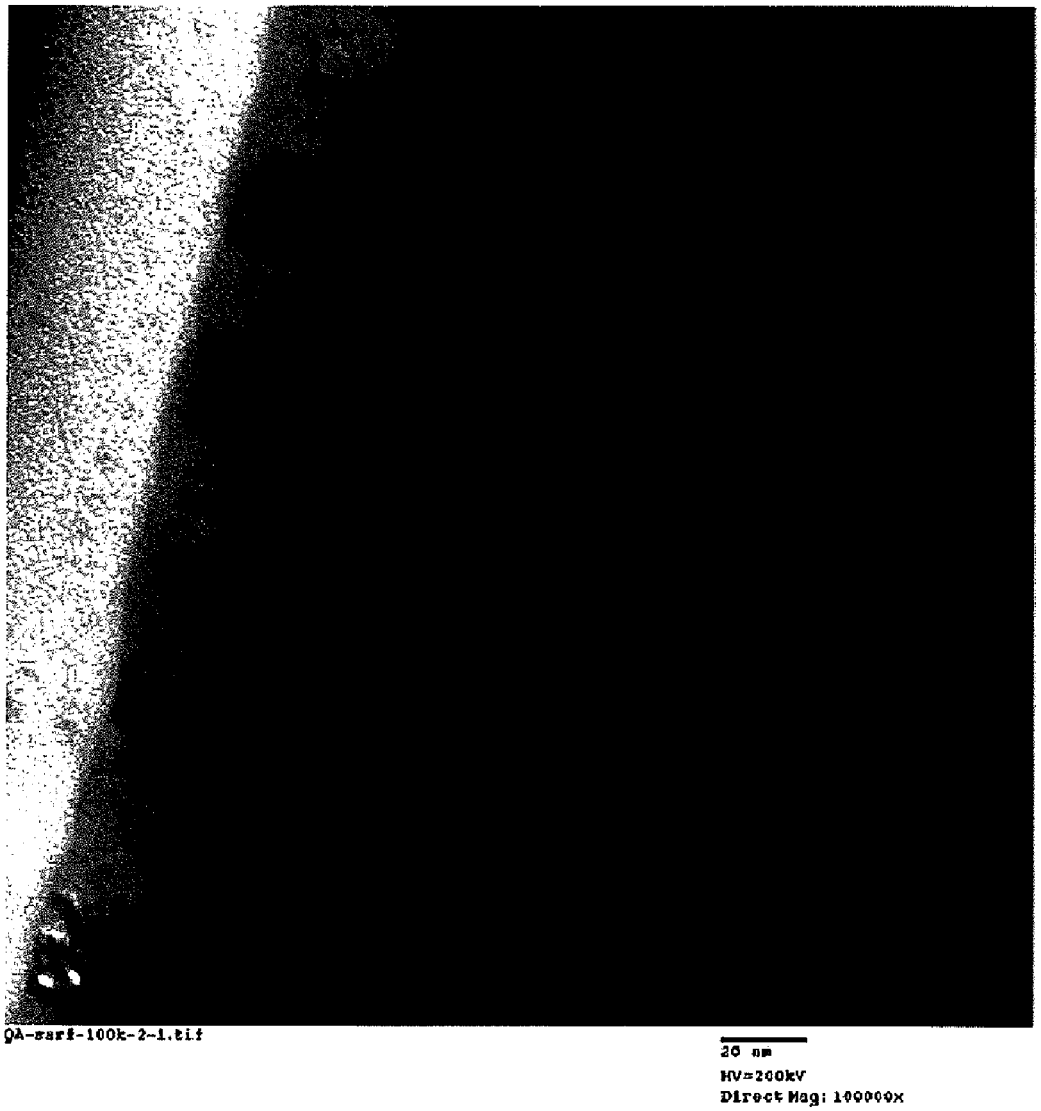
FIG. 4 is a cross-sectional structure photograph near the surface taken with a transmission electron microscope.
Figure 5:
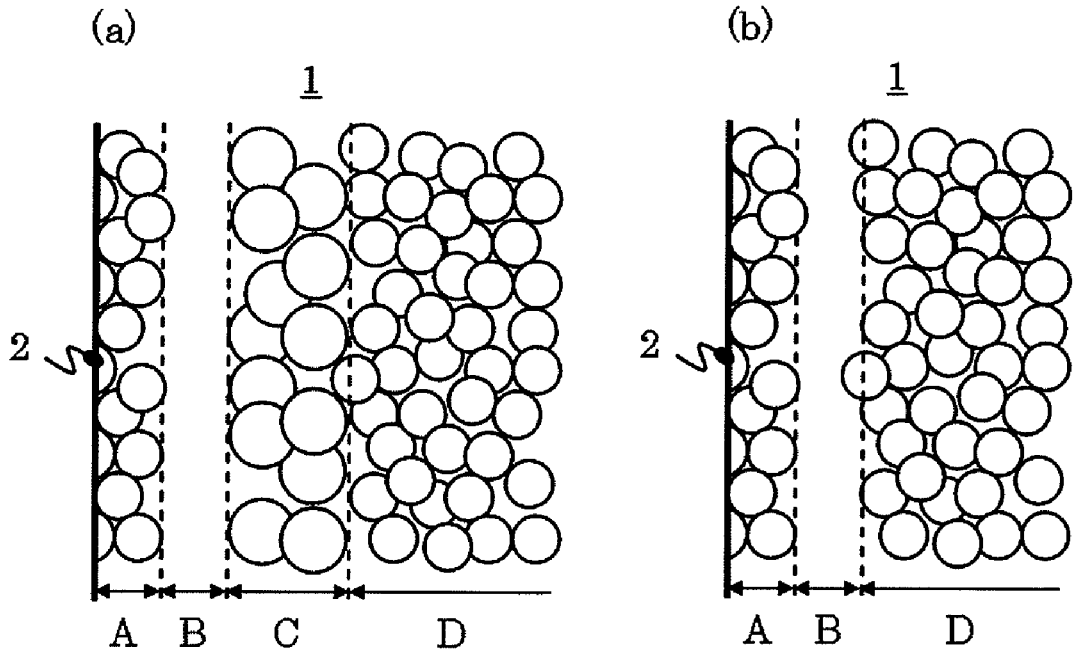
FIG. 5 is a schematic diagram showing the state of a structure of the soft magnetic ribbon of the present invention.
Figure 6:
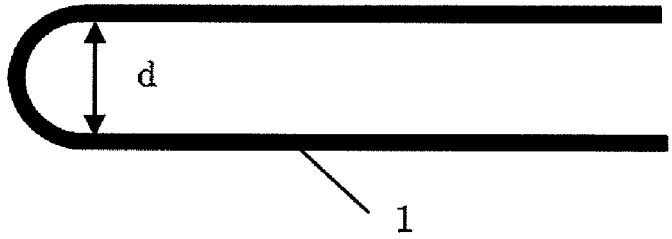
FIG. 6 is a schematic diagram illustrating the bending of a single plate.
Figure 7:
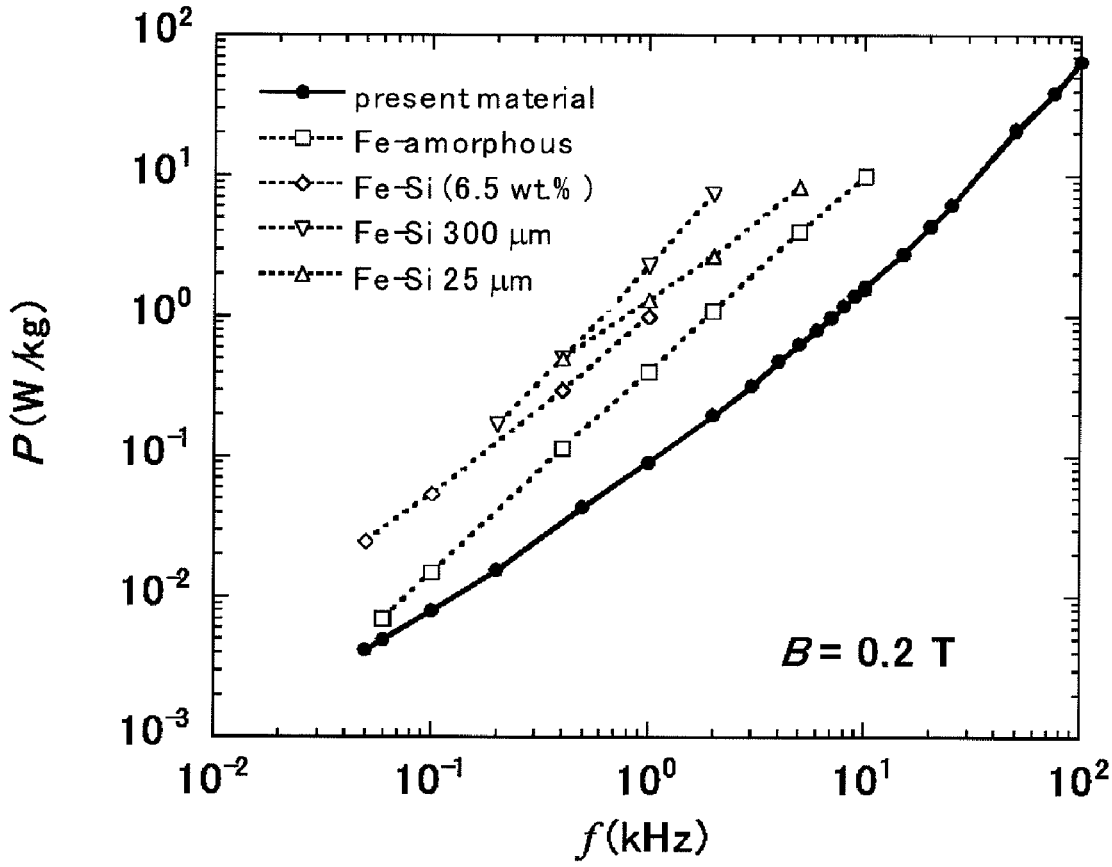
FIG. 7 shows the frequency dependence of iron loss.
Figure 8:
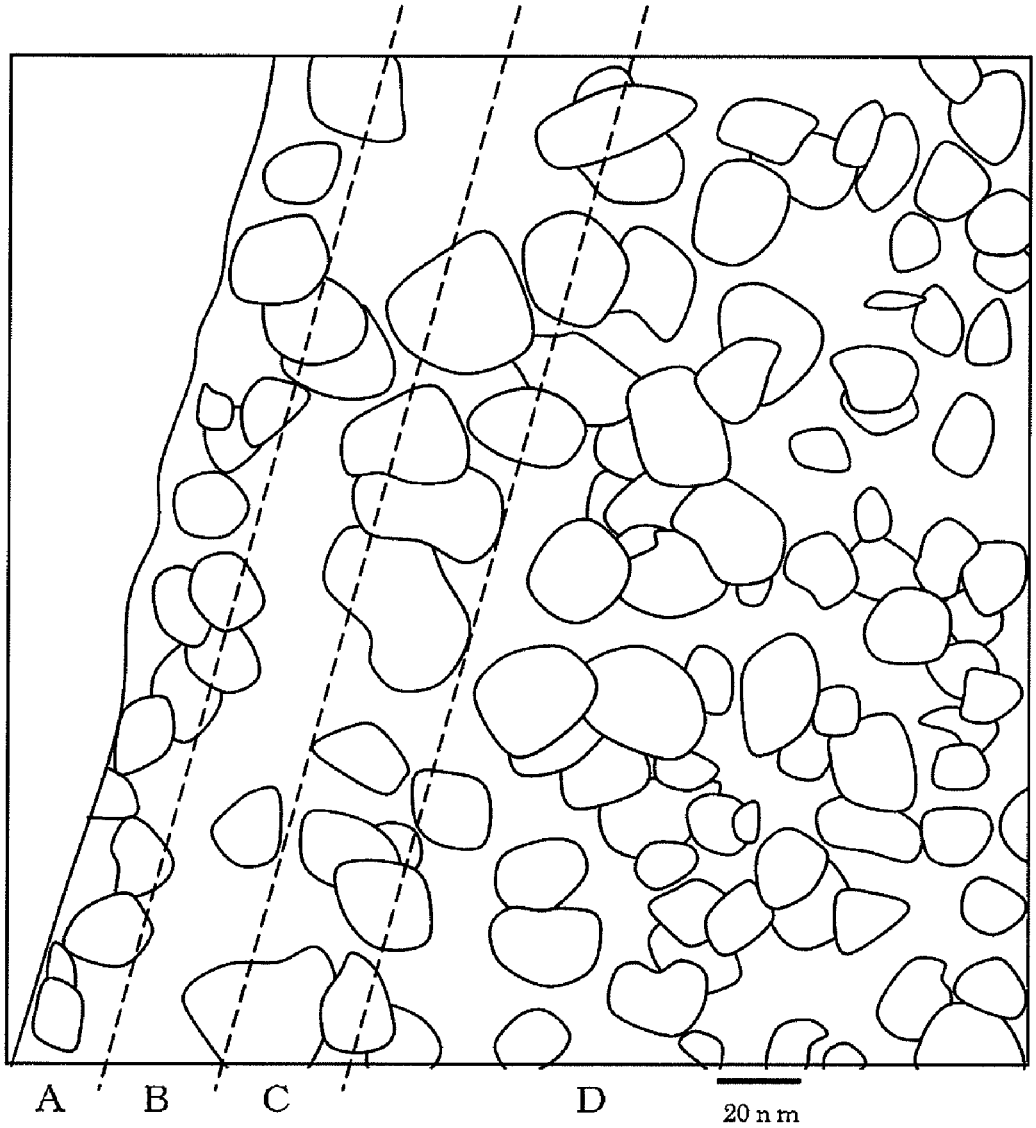
FIG. 8 is a schematic diagram of the structural photograph of FIG. 4.
Figure 9:
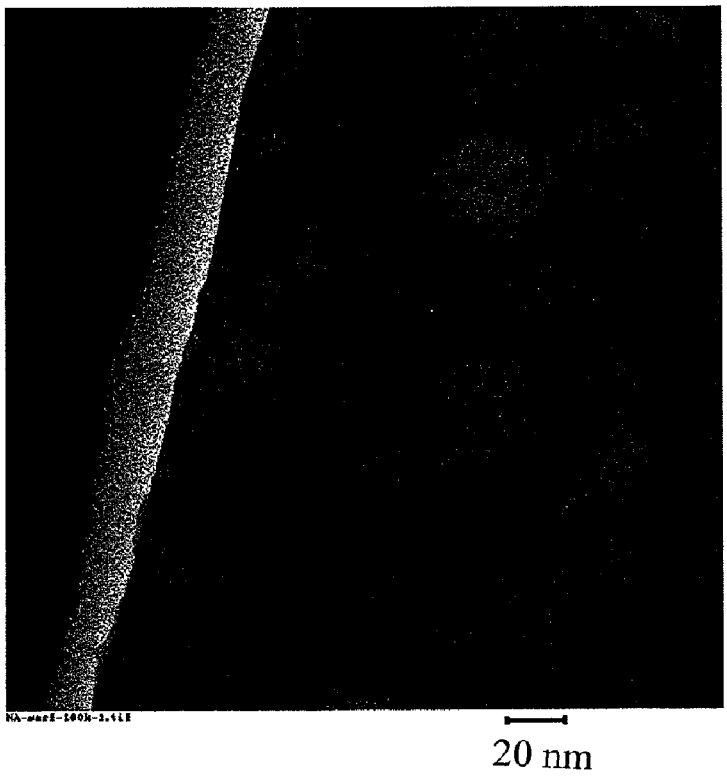
FIG. 9 is a structural photograph showing a layer structure observed near the surface of a soft magnetic ribbon.
Figure 10:
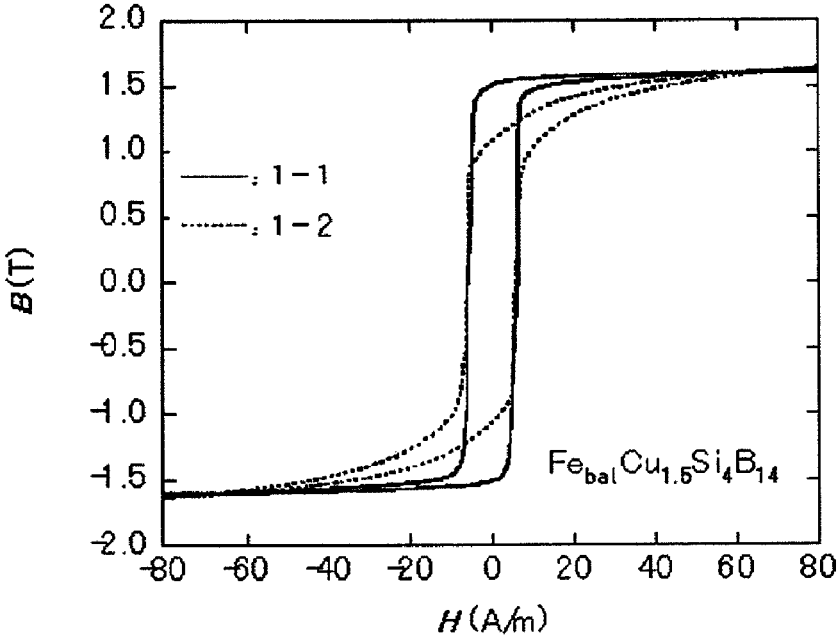
FIG. 10 shows B-H curves comparing the samples obtained by changing the speed of temperature rise in annealing (maximum magnetic field of 80 A/m)
Figure 11:
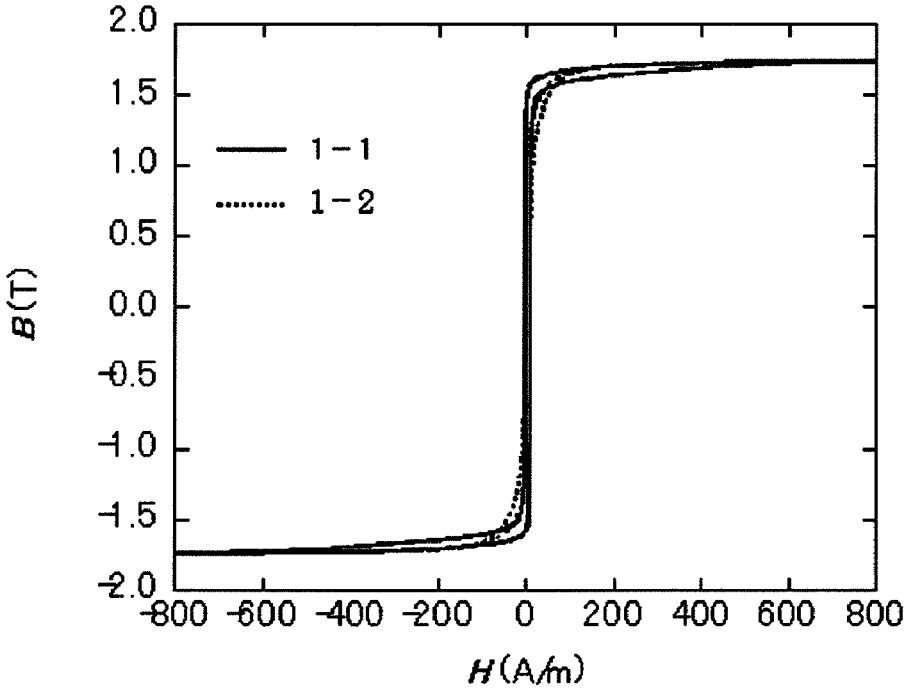
FIG. 11 shows B-H curves comparing the samples obtained by changing the rate of temperature rise in annealing (maximum magnetic field of 800 A/m)
Figure 12:
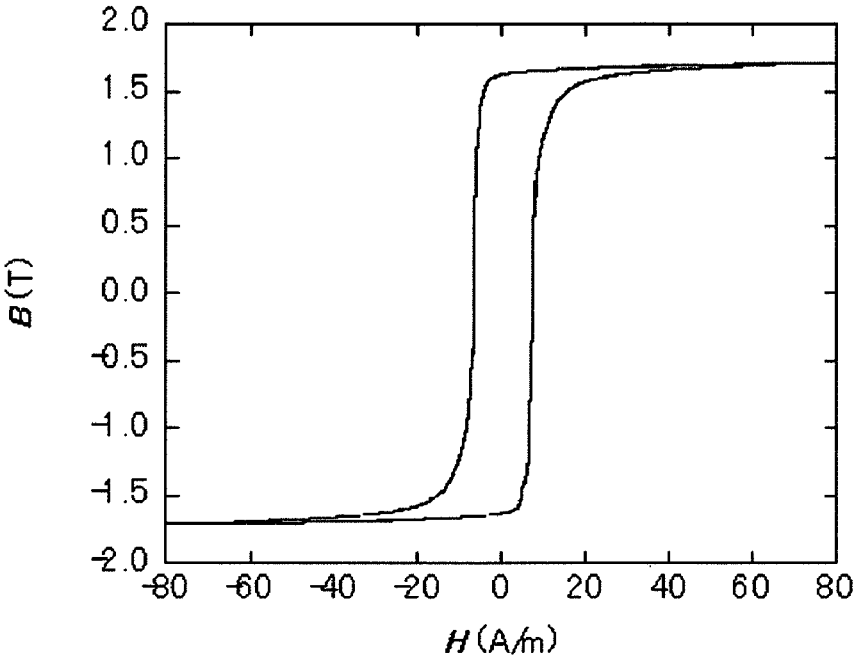
FIG. 12 shows a B-H curve of the soft magnetic ribbon in 3 (maximum magnetic field of 80 A/m)
Figure 13:
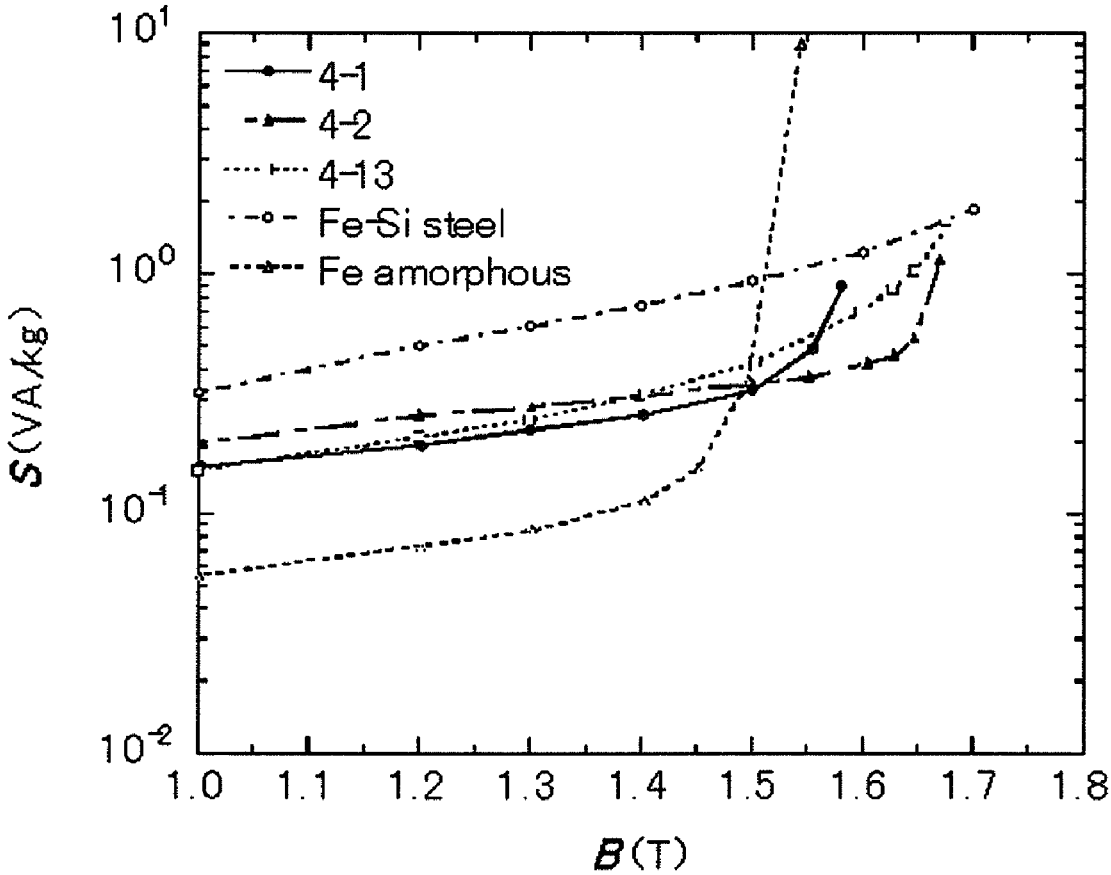
FIG. 13 shows the magnetic flux density dependence of the apparent power of soft magnetic materials.
Figure 14:
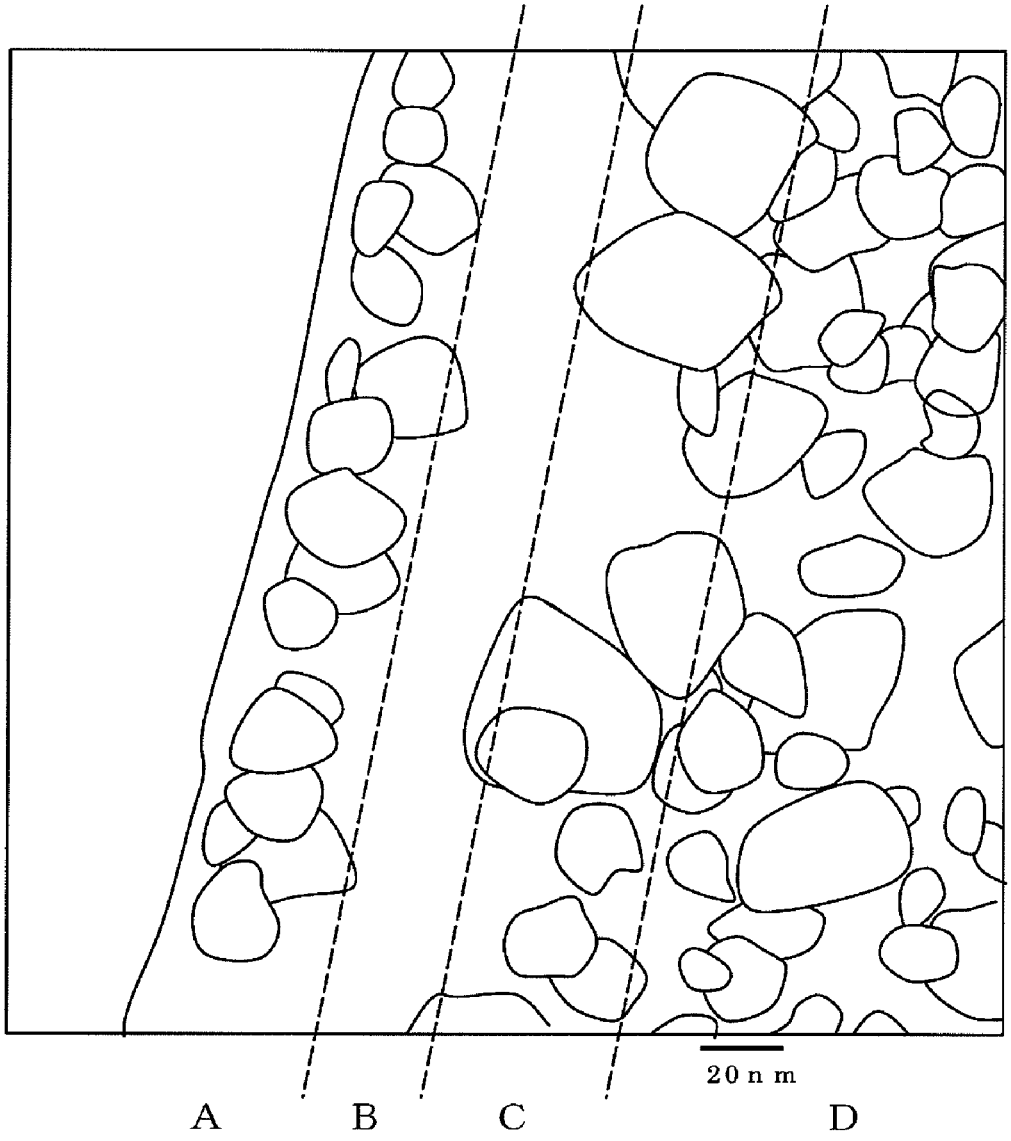
FIG. 14 is a schematic diagram of the structural photograph of FIG. 2.
Figure 15:
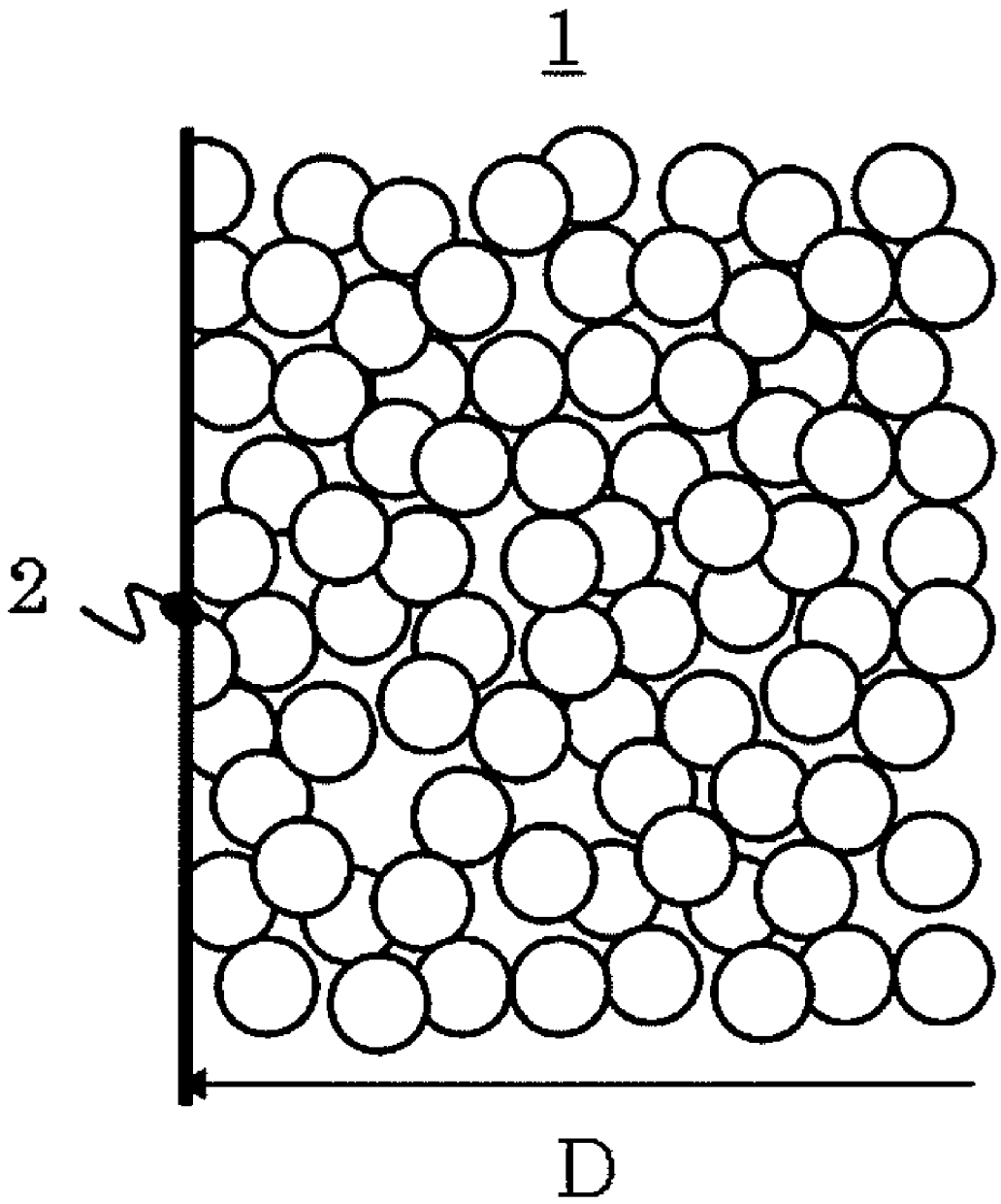
FIG. 15 is a schematic diagram showing the state of a structure of a conventional soft magnetic ribbon.

1: Soft magnetic ribbon, 2: Surface of ribbon

The invention claimed is:

1. A soft magnetic ribbon comprising: a matrix where crystal grains having a crystal grain size of 60 nm or less (not including 0) are dispersed in an amorphous phase in the volume fraction of 30% or more, and an amorphous layer formed on a surface side of the matrix.

2. The soft magnetic ribbon according to claim 1 further comprising: a crystal layer comprising a crystal structure formed on a top surface of the soft magnetic ribbon, wherein the amorphous layer is formed below the crystal layer.

3. The soft magnetic ribbon according to claim 1 comprising a coarse crystal grain layer between the amorphous layer and the matrix, wherein the coarse crystal grain layer comprises crystals having a larger grain size than the average grain size of the crystal grains in the matrix.

4. The soft magnetic ribbon according to claim 1, wherein the soft magnetic ribbon is represented by a composition formula $Fe_{100-x-y}A_xX_y$, (wherein A is at least one element selected from Cu and Au; X is at least one element selected from the group consisting of B, Si, S, C, P, Al, Ge, Ga, and Be; and x and y are defined by $0<x\leqq5$ and $10\leqq y\leqq24$, respectively, in atom %).

5. The soft magnetic ribbon according to claim 1, wherein a ratio $Br/B_{80}$ of a residual magnetic flux density Br after application of a magnetic field to a magnetic flux density $B_{80}$ in a magnetic field of 80 A/m is 90% or more.

6. A magnetic core comprising a soft magnetic ribbon according to claim 1, wherein an iron loss of the magnetic core at a magnetic flux density of 1.5 T and 50 Hz is 0.5 W/kg or less.

7. A soft magnetic ribbon, comprising: a matrix where crystal grains having a crystal grain size of 60 nm or less (not including 0) are dispersed in an amorphous phase in the volume fraction of 30% or more, at a position of 120 nm in depth from a surface of the ribbon; and an amorphous layer formed at a depth of 120 nm or less from the surface of the ribbon.

8. The soft magnetic ribbon according to claim 7 further comprising: a crystal layer comprising a crystal structure formed on a top surface of the soft magnetic ribbon, wherein the amorphous layer is formed below the crystal layer.

9. The soft magnetic ribbon according to claim 7 comprising a coarse crystal grain layer between the amorphous layer and the matrix, wherein the coarse crystal grain layer comprises crystals having a larger grain size than the average grain size of the crystal grains in the matrix.

10. The soft magnetic ribbon according to claim 7, wherein the soft magnetic ribbon is represented by a composition formula $Fe_{100-x-y}A_xX_y$, (wherein A is at least one element selected from Cu and Au; X is at least one element selected from the group consisting of B, Si, S, C, P, Al, Ge, Ga, and Be; and x and y are defined by $0<x\leqq5$ and $10\leqq y\leqq24$, respectively, in atom %).

11. A magnetic core comprising a soft magnetic ribbon according to claim 7, wherein an iron loss of the magnetic core is 0.65 W/kg or less as measured at a magnetic flux density of 1.6 T and a frequency of 50 Hz.

12. A process for producing a soft magnetic ribbon comprising the steps of: rapidly cooling a molten alloy containing Fe and a metalloid element to produce a Fe-based alloy comprising a structure where crystal grains having an average grain size of 30 nm or less (not including 0 nm) are dispersed in an amorphous phase in the volume fraction of more than 0% and less than 30%; and subjecting the Fe-based alloy to annealing to form a structure where crystal grains of a body-centered cubic structure having an average grain size of 60 nm or less are dispersed in the amorphous phase in the volume fraction of 30% or more, wherein the annealing step is performed so that the average speed of temperature rise at 300° C. or higher is 100° C/min or more.

13. The process for producing a soft magnetic ribbon according to claim 12, wherein the Fe-based alloy is represented by a composition formula $Fe_{100-x-y}A_xX_y$, (wherein A is at least one element selected from Cu and Au; X is at least one element selected from the group consisting of B, Si, S, C, P, Al, Ge, Ga, and Be; and x and y are defined by $0<x\leqq5$ and $10\leqq y\leqq24$, respectively, in atom %).

14. A magnetic part comprising a soft magnetic ribbon according to claim 1.

15. A magnetic part comprising a soft magnetic ribbon according to claim 2.

16. A magnetic part comprising a soft magnetic ribbon according to claim 3.

17. A magnetic part comprising a soft magnetic ribbon according to claim 4.

18. A magnetic part comprising a soft magnetic ribbon according to claim 5.

19. A magnetic part comprising a soft magnetic ribbon according to claim 7.

20. A magnetic part comprising a soft magnetic ribbon according to claim 8.

21. A magnetic part comprising a soft magnetic ribbon according to claim 9.

22. A magnetic part comprising a soft magnetic ribbon according to claim 10.

23. A magnetic part comprising a soft magnetic ribbon according to claim 11.

24. A magnetic part comprising a magnetic core according to claim 6.

25. A magnetic part comprising a magnetic core according to claim 11.

* * * * *